US010565975B2

(12) United States Patent
Woelfl et al.

(10) Patent No.: US 10,565,975 B2
(45) Date of Patent: Feb. 18, 2020

(54) SYSTEMS AND METHODS FOR GENERATING NATURAL DIRECTIONAL PINNA CUES FOR VIRTUAL SOUND SOURCE SYNTHESIS

(71) Applicant: Harman Becker Automotive Systems GmbH, Karlsbad (DE)

(72) Inventors: Genaro Woelfl, Salching (DE); Matthias Kronlachner, Regensburg (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 30 days.

(21) Appl. No.: 15/860,451

(22) Filed: Jan. 2, 2018

(65) Prior Publication Data

US 2018/0192226 A1 Jul. 5, 2018

(30) Foreign Application Priority Data

Jan. 4, 2017 (EP) ..... 17150264

(51) Int. Cl.
*H04S 7/00* (2006.01)
*H04R 5/033* (2006.01)
(Continued)

(52) U.S. Cl.
CPC ..... *G10K 11/17815* (2018.01); *G10K 1/38* (2013.01); *G10K 11/17827* (2018.01);
(Continued)

(58) Field of Classification Search
CPC ..... G10K 11/17815; G10K 11/17881; G10K 11/17827; G10K 1/38; G10K 2210/1081;
(Continued)

(56) References Cited

U.S. PATENT DOCUMENTS 6,038,330 A 3/2000 Meucci, Jr.
2012/0219165 A1* 8/2012 Yamada ..... H04R 1/1091 381/310

FOREIGN PATENT DOCUMENTS

EP 2493211 A2 8/2012
JP 2009141880 A 6/2009

OTHER PUBLICATIONS

Woelfl, G., "Arrangements and Methods for 3D Audio Generation," U.S. Appl. No. 15/860,468, filed Jan. 2, 2018, 60 pages.
(Continued)

*Primary Examiner* — Paul Kim
*Assistant Examiner* — Douglas J Suthers
(74) *Attorney, Agent, or Firm* — McCoy Russell LLP

(57) ABSTRACT

A method for binaural synthesis of at least one virtual sound source comprises operating a first device comprising at least four physical sound sources, wherein, when the first device is used by a user, at least two physical sound sources are positioned closer to a first ear of the user than to a second ear, and at least two physical sound sources are positioned closer to the second ear than to the first ear, and wherein, for each ear, at least two physical sound sources are configured to acoustically induce natural directional pinna cues associated with different directions of sound arrival at the ear of the user. The method further comprises receiving and processing at least one audio input signal and distributing at least one processed version of the audio input signal at least between 4 kHz and 12 kHz over at least two physical sound sources for each ear.

17 Claims, 14 Drawing Sheets

(51) Int. Cl.

| | |
|---|---|
| ***H04S 5/02*** | (2006.01) |
| ***G10K 11/178*** | (2006.01) |
| ***H04R 1/02*** | (2006.01) |
| ***H04R 1/10*** | (2006.01) |
| ***H04R 5/02*** | (2006.01) |
| ***H04R 5/04*** | (2006.01) |
| ***H04S 3/00*** | (2006.01) |
| ***H04R 3/02*** | (2006.01) |
| ***G10K 1/38*** | (2006.01) |

(52) U.S. Cl.
CPC ..... *G10K 11/17881* (2018.01); *H04R 1/028* (2013.01); *H04R 1/1008* (2013.01); *H04R 1/1083* (2013.01); *H04R 3/02* (2013.01); *H04R 5/02* (2013.01); *H04R 5/033* (2013.01); *H04R 5/04* (2013.01); *H04S 3/008* (2013.01); *H04S 5/02* (2013.01); *H04S 7/304* (2013.01); *H04S 7/306* (2013.01); *G10K 11/178* (2013.01); *G10K 2210/1081* (2013.01); *G10K 2210/128* (2013.01); *G10K 2210/3026* (2013.01); *G10K 2210/3044* (2013.01); *G10K 2210/3046* (2013.01); *H04R 2205/022* (2013.01); *H04R 2460/01* (2013.01); *H04R 2499/13* (2013.01); *H04S 2400/01* (2013.01); *H04S 2400/11* (2013.01); *H04S 2420/01* (2013.01)

(58) Field of Classification Search
CPC ..... G10K 2210/128; G10K 2210/3046; G10K 2210/3044; G10K 2210/3026; G10K 11/178; H04R 1/028; H04R 1/1008; H04R 1/1083; H04R 3/02; H04R 5/02; H04R 5/033; H04R 5/04; H04R 2499/13; H04R 2205/022; H04R 2460/01; H04S 5/02; H04S 7/304; H04S 3/008; H04S 7/306; H04S 2420/01; H04S 2400/01; H04S 2420/11
USPC ..... 381/17
See application file for complete search history.

(56) References Cited

OTHER PUBLICATIONS

Woelfl, G. et al., "Arrangements and Methods for Active Noise Cancelling," U.S. Appl. No. 15/860,546, filed Jan. 2, 2018, 36 pages.
Woelfl, G. et al., "Arrangements and Methods for Generating Natural Directional Pinna Cues," U.S. Appl. No. 15/860,489, filed Jan. 2, 2018, 61 pages.
European Patent Office, Extended European Search Report Issued in Application No. 17209913.7, dated Feb. 14, 2018, Germany, 11 pages.

* cited by examiner

SYSTEMS AND METHODS FOR GENERATING NATURAL DIRECTIONAL PINNA CUES FOR VIRTUAL SOUND SOURCE SYNTHESIS

CROSS REFERENCE TO RELATED APPLICATIONS

The present application claims priority to European Patent Application No. EP17150264.4 entitled "ARRANGEMENTS AND METHODS FOR GENERATING NATURAL DIRECTIONAL PINNA CUES", and filed on Jan. 4, 2017. The entire contents of the above-listed application are hereby incorporated by reference for all purposes.

TECHNICAL FIELD

The disclosure relates to systems and methods for controlled generation of natural directional pinna cues and binaural synthesis of virtual sound sources, in particular for improving the spatial representation of stereo as well as 2D and 3D surround sound content over headphones and other devices that place sound sources close to a user's pinna.

BACKGROUND

Most headphones available on the market today produce an in-head sound image when driven by a conventionally mixed stereo signal. "In-head sound image" in this context means that the predominant part of the sound image is perceived as being originated inside the listeners head, usually on an axis between the ears. If sound is externalized by suitable signal processing methods (externalizing in this context means the manipulation of the spatial representation in a way such that the predominant part of the sound image is perceived as being originated outside the listeners head), the center image tends to move mainly upwards instead of moving towards the front of the listener. While especially binaural techniques based on HRTF filtering are very effective in externalizing the sound image and even positioning virtual sound sources on most positions around the listeners head, such techniques usually fail to position virtual sources correctly on a frontal part of the median plane (in front of the user). This means that neither the (phantom) center image of conventional stereo systems nor the center channel of common surround sound formats can be reproduced at the correct position when played over commercially available headphones, although those positions are the most important positions for stereo and surround sound presentation.

SUMMARY

A method for binaural synthesis of at least one virtual sound source includes operating a first device that includes at least four physical sound sources, wherein, when the first device is used by a user, at least two physical sound sources are positioned closer to a first ear of the user than to a second ear, and at least two physical sound sources are positioned closer to the second ear than to the first ear, and wherein, for each ear of the user, at least two physical sound sources are configured to acoustically induce natural directional pinna cues associated with different directions of sound arrival at the ear of the user. The method further includes receiving and processing at least one audio input signal and distributing at least one processed version of the audio input signal at least between 4 kHz and 12 kHz over at least two physical sound sources for each ear.

A sound device includes at least four physical sound sources, wherein, when the sound device is used by a user, two of the physical sound sources are positioned closer to a first ear of the user than to a second ear, and two of the physical sound sources are positioned closer to the second ear than to the first ear, and wherein, for each ear of the user, at least two physical sound sources are configured to induce natural directional pinna cues associated with different directions of sound arrival at the ear of the user. The sound device further includes a processor for carrying out the steps of a method for binaural synthesis of at least one virtual sound source.

Other systems, methods, features and advantages will be or will become apparent to one with skill in the art upon examination of the following detailed description and figures. It is intended that all such additional systems, methods, features and advantages be included within this description, be within the scope of the disclosure and be protected by the following claims.

BRIEF DESCRIPTION OF THE DRAWINGS

The method may be better understood with reference to the following description and drawings. The components in the figures are not necessarily to scale, emphasis instead being placed upon illustrating the principles of the disclosure. Moreover, in the figures, like referenced numerals designate corresponding parts throughout the different views.

DETAILED DESCRIPTION

Most headphones available on the market today produce an in-head sound image when driven by a conventionally mixed stereo signal. "In-head sound image" in this context means that the predominant part of the sound image is perceived as being originated inside the user's head, usually on an axis between the ears (running through the left and the right ear, see axis x in FIG. 3). 5.1 surround sound systems usually use five speaker channels, namely front left and right channel, center channel and two surround rear channels. If a stereo or 5.1 speaker system is used instead of headphones, the phantom center image or center channel image is produced in front of the user. When using headphones, however, these center images are usually perceived in the middle of the axis between the user's ears.

Figure 3:
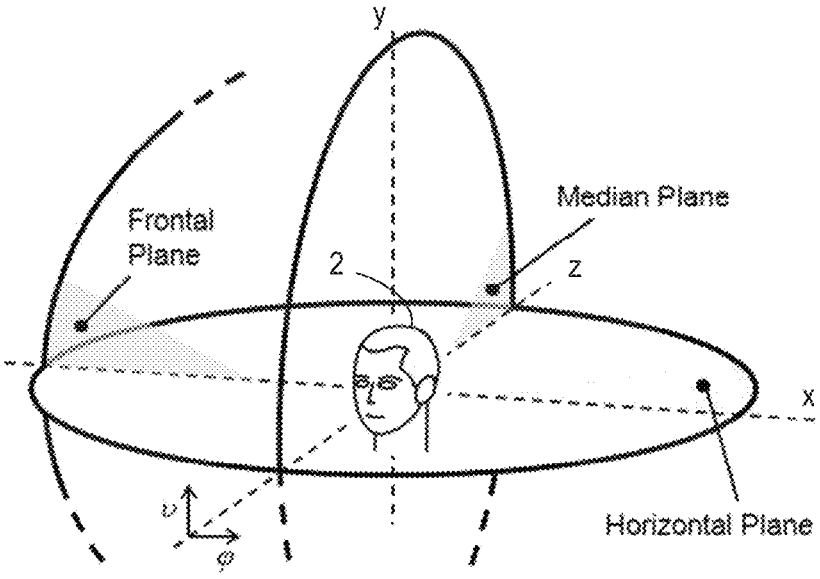
FIG. 3 schematically illustrates different planes and angles for source localization.

Sound source positions in the space surrounding the user can be described by means of an azimuth angle φ (position left to right), an elevation angle ν (position up and down) and a distance measure (distance of the sound source from the user). The azimuth and the elevation angle are usually sufficient to describe the direction of a sound source. The human auditory system uses several cues for sound source localization, including interaural time difference (ITD), interaural level difference (ILD), and pinna resonance and cancellation effects, that are all combined within the head related transfer function (HRTF). FIG. 3 illustrates the planes of source localization, namely a horizontal plane (also called transverse plane) which is generally parallel to the ground surface and which divides the user's head in an upper part and a lower part, a median plane (also called midsagittal plane) which is perpendicular to the horizontal plane and, therefore, to the ground surface and which crosses the user's head approximately midway between the user's ears, thereby dividing the head in a left half side and a right half side, and a frontal plane (also called coronal plane) which equally divides anterior aspects and posterior aspects and which lies at right angles to both the horizontal plane and the median plane. Azimuth angle φ and elevation angle ν are also illustrated in FIG. 3 as well as the three axes x, y, z. Headphones are usually designed identically for both ears with respect to acoustical characteristics and are placed on both ears in a virtually similar position relative to the respective ear. A first axis x runs through the ears of the user 2. In the following, it will be assumed that the first axis x crosses the concha of the user's ear. The first axis x is parallel to the frontal plane and the horizontal plane, and perpendicular to the median plane. A second axis y runs vertically through the user's head, perpendicular to the first axis x. The second axis y is parallel to the median plane and the frontal plane, and perpendicular to the horizontal plane. A third axis z runs horizontally through the user's head (from front to back), perpendicular to the first axis x and the second axis y. The third axis z is parallel to the median plane and the horizontal plane, and perpendicular to the frontal plane. The position of the different planes x, y, z will be described in greater detail below.

Figure 1A:
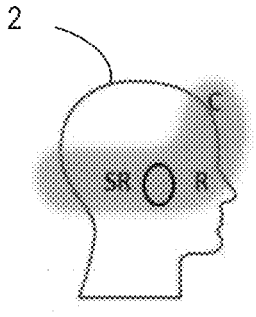
FIGS. 1A and 1B schematically illustrate a typical path of virtual sources positioned around a user's head.
Figure 1B:
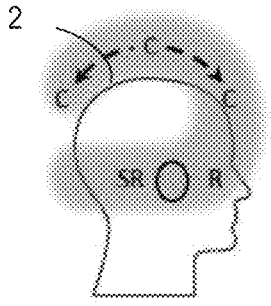

If sound in conventional headphone arrangements is externalized by suitable signal processing methods (externalizing in this context means that at least the predominant part of the sound image is perceived as being originated outside the user's head), the center channel image of surround sound content or the center-steered phantom image of stereo sound content tend to move mainly upwards instead of to the front. This is exemplarily illustrated in FIG. 1A, wherein SR identifies the surround rear image location, R identifies the front right image location and C identifies the center channel image location. Virtual sound sources may, for example, be located somewhere on and travel along the path of possible source locations as is indicated in FIG. 1A if the azimuth angle φ (see FIG. 3) is incrementally shifted from 0° to 360° for binaural synthesis, based on generalized head related transfer functions (HRTF) from the horizontal plane. While especially binaural techniques based on HRTF filtering are very effective in externalizing the sound image and even positioning virtual sound sources on most positions around the user's head, such techniques usually fail to position sources correctly on a frontal part of the median plane. A further problem that may occur is the so-called front-back confusion, as is illustrated in FIG. 1B. Front-back confusion means that the user 2 is not able to locate the image reliably in the front of his head, but anywhere above or even behind his head. This means that neither the center sound image of conventional stereo systems nor the center channel sound image of common surround sound formats can be reproduced at the correct position when played over commercially available headphones, although those positions are the most important positions for stereo and surround sound presentation.

Sound sources that are arranged in the median plane (azimuth angle $\varphi=0°$) lack interaural differences in time (ITD) and level (ILD) which could be used to position virtual sources. If a sound source is located on the median plane, the distance between the sound source and the ear as well as the shading of the ear through the head are the same to both the right ear and the left ear. Therefore, the time the sound needs to travel from the sound source to the right ear is the same as the time the sound needs to travel from the sound source to the left ear and the amplitude response alteration caused by the shading of the ear through parts of the head is also equal for both ears. The human auditory system analyzes cancellation and resonance magnification effects that are produced by the pinnae, referred to as pinna resonances in the following, to determine the elevation angle on the median plane. Each source elevation angle and each pinna generally provokes very specific and distinct pinna resonances.

Pinna resonances may be applied to a signal by means of filters derived from HRTF measurements. However, attempts to apply foreign (e.g., from another human individual), generalized (e.g., averaged over a representative group of individuals), or simplified HRTF filters usually fail to deliver a stable location of the source in the front, due to strong deviations between the individual pinnae. Only individual HRTF filters are usually able to generate stable frontal images on the median plane if applied in combination with individual headphone equalizing. However, such a degree of individualization of signal processing is almost impossible for consumer mass market.

Figure 2:
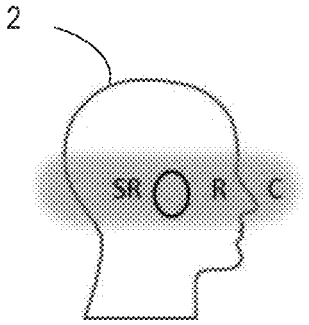
FIG. 2 schematically illustrates a possible path of virtual sources positioned around a user's head.

The present disclosure includes sound source arrangements and corresponding methods that are capable of generating strong directional pinna cues for the frontal hemisphere in front of a user's head 2 and/or appropriate cues for the rear hemisphere behind the user's head 2. A sound source may include at least one loudspeaker, at least one sound canal outlet, at least one sound tube outlet, at least one acoustic waveguide outlet and/or at least one acoustic reflector, for example. For example, a sound source may comprise a sound canal or sound tube. One or more may emit sound into the sound canal or sound tube. The sound canal or sound tube comprises an outlet. The outlet may face in the direction of the user's ear. Therefore, sound that is generated by at least one loudspeaker is emitted into the sound canal or sound tube, and exits the sound canal our sound tube through the outlet in the direction of the user's ear. Acoustic waveguides or reflectors may also direct sound in the direction of the user's ear. Some of the proposed sound source arrangements support the generation of an improved centered frontal sound image and embodiments of the disclosure are further capable of positioning virtual sound sources all around the user's head 2, using appropriate signal processing. This is exemplarily illustrated in FIG. 2, where the center channel image C is located at a desired position in front of the user's head 2. If directional pinna cues associated with the frontal and rear hemisphere are available and can be individually controlled, for example if they are produced by separate loudspeakers, it is possible to position virtual sources all around the user's head if, in addition, suitable signal processing is applied, as will be described in the following.

Within this document, the terms pinna cues and pinna resonances are used to denominate the frequency and phase response alterations imposed by the pinna and possibly also the ear canal in response to the direction of arrival of the sound. The terms directional pinna cues and directional pinna resonances within this document have the same meaning as the terms pinna cues and pinna resonances, but are used to emphasize the directional aspect of the frequency and phase response alterations produced by the pinna. Furthermore, the terms natural pinna cues, natural directional pinna cues and natural pinna resonances are used to point out that these resonances are actually generated by the user's pinna in response to a sound field in contrast to signal processing that emulates the effects of the pinna (artificial pinna cues). Generally, pinna resonances that carry distinct directional cues are excited if the pinna is subjected to a direct, approximately unidirectional sound field from the desired direction. This means that sound waves emanating from a source from a certain direction hit the pinna without the addition of very early reflected sounds of the same sound source from different directions. While humans are generally able to determine the direction of a sound source in the presence of typical early room reflections, reflections that arrive within a too short time window after the direct sound will alter the perceived sound direction.

Known stereo headphones generally can be grouped into in-ear, over-ear and around-ear types. Around-ear types are commonly available as so-called closed-back headphones with a closed back or as so-called open-back headphones with a ventilated back. Headphones may have a single or multiple drivers (loudspeakers). Besides high quality in-ear headphones, specific multi-way surround sound headphones exist that utilize multiple loudspeakers aiming on generation of directional effects.

In-ear headphones are generally not able to generate natural pinna cues, due to the fact that the sound does not pass the pinna at all and is directly emitted into the ear canal. Within a fairly large frequency range, on-ear and around-ear headphones having a closed back produce a pressure chamber around the ear that usually either completely avoids pinna resonances or at least alters them in an unnatural way. In addition, this pressure chamber is directly coupled to the ear canal which alters ear canal resonances as compared to an open sound-field, thereby further obscuring natural directional cues. At higher frequencies, elements of the ear cups reflect sound, whereby a diffuse sound field is produced that cannot induce pinna resonances associated with a single direction. Some open headphones may avoid such drawbacks. Headphones with a closed ear cup forming an essentially closed chamber around the ear, however, also provide several advantages, e.g., with regard to loudspeaker sensitivity and frequency response extension.

Typical open-back headphones as well as most closed-back around-ear and on-ear headphones that are available on the market today utilize large diameter loudspeakers. Such large diameter loudspeakers are often almost as big as the pinna itself, thereby producing a large plane sound wave from the side of the head that is not appropriate to generate consistent pinna resonances as would result from a directional sound field from the front. Additionally, the relatively large size of such loudspeakers as compared to the pinna, as well as the close distance between the loudspeaker and the pinna and the large reflective surface of such loudspeakers result in an acoustic situation which resembles a pressure chamber for low to medium frequencies and a reflective environment for high frequencies. Both situations are detrimental to the induction of natural directional pinna cues associated with a single direction.

Surround sound headphones with multiple loudspeakers usually combine loudspeaker positions on the side of the pinna with a pressure chamber effect and reflective environments. Such headphones are usually not able to generate consistent directional pinna cues, especially not for the frontal hemisphere.

Generally all kinds of objects that cover the pinna, such as back covers of headphones or large loudspeakers themselves may cause multiple reflections within the chamber around the ear which generates a diffused sound field that is detrimental for natural pinna effects as caused by directional sound fields.

Optimized headphone arrangements allow to send direct sound towards the pinna from all desired directions while minimizing reflections, in particular reflections from the headphone arrangement. While pinna resonances are widely accepted to be effective above frequencies of about 2 kHz, real world loudspeakers usually produce various kinds of noise and distortion that will allow the localization of the loudspeaker even for substantially lower frequencies. The user may also notice differences in distortion, temporal characteristics (e.g., decay time) and directivity between different speakers used within the frequency spectrum of the human voice. Therefore, a lower frequency limit in the order of about 200 Hz or lower may be chosen for the loudspeakers that are used to induce directional cues with natural pinna resonances, while reflections may be controlled at least for higher frequencies (e.g., above 2-4 kHz).

Generating a stable frontal image on the median plane presents the presumably highest challenge compared to generating a stable image from other directions. Generally the generation of individual directional pinna cues is more important for the frontal hemisphere (in front of the user) than for the rear hemisphere (behind the user). Effective natural directional pinna cues, however, are easier to induce for the rear hemisphere for which the replacement with generalized cues is generally possible with good effects at least for standard headphones which place loudspeakers at the side of the pinna. Therefore, some headphone arrangements are known which focus on optimization of frontal hemisphere cues while providing weaker, but still adequate, directional cues for the rear hemisphere. Other arrangements may provide equally good directional cues for each of the front and rear direction. To achieve strong natural directional pinna cues, a headphone arrangement may be configured such that the sound waves emanated by one or more loudspeakers mainly pass the pinna, or at least the concha, once from the desired direction with reduced energy in reflections that may occur from other directions. Some arrangements may focus on the reduction of reflections for loudspeakers in the frontal part of the ear cups, while other arrangements may minimize reflections independent from the position of the loudspeaker. It may be avoided to put the ear into a pressure chamber, at least above 2 kHz, or to generate excessive reflections which tend to cause a diffuse sound field. To avoid reflections, at least one loudspeaker may be positioned on the ear cup such that it results in the desired direction of the sound field. The support structure or headband and the back volume of the ear cup may be arranged such that reflections are avoided or minimized.

Optimized headphone arrangements are known that allow sending direct sound towards the pinna from all desired directions while minimizing reflections, in particular reflections from the headphone arrangement. While pinna resonances are widely accepted to be effective above frequencies of about 2 kHz, real world loudspeakers usually produce various kinds of noise and distortion that will allow the localization of the loudspeaker even for substantially lower frequencies. The user may also notice differences in distortion, temporal characteristics (e.g., decay time) and directivity between different speakers used within the frequency spectrum of the human voice. Therefore, a lower frequency limit in the order of about 200 Hz or lower may be chosen for the loudspeakers that are used to induce directional cues with natural pinna resonances, while reflections may be controlled at least for higher frequencies (e.g., above 2-4 kHz).

As has been described above, most headphones today produce an in-head sound image, where the predominant part of the sound image is perceived as being originated inside the user's head on an axis between the ears. The sound image may be externalized by suitable processing methods or with headphone arrangements as have been mentioned above, for example.

Figure 37:
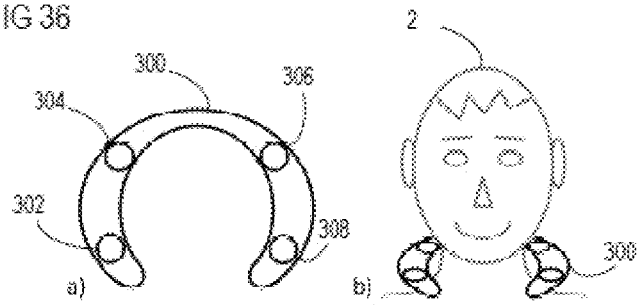

If sound sources are positioned closely around the head of a user, for example within about 40 cm from the center of the head, comparable sound image localization effects to that described for headphones above (elevated frontal center position, front-back confusion) may occur to various extents. The strength of the effects generally depends on the position and the distance of the sound sources with respect to the user's ears as well as on radiation characteristics of the sound sources utilized for audio signal playback or, more generally speaking, on the directional cues that these sound sources generate in the user's ears. Therefore, most audio playback devices on the market today, besides headphones or headsets, which position loudspeakers, or more generally speaking sound sources, close to the user's head, are not able to produce a stable frontal image outside the user's head. Devices that can produce an image in front of the head, which may include single loudspeakers that are positioned at a similar distance with respect to both respective ears of the user, usually do not provide sufficient left to right separation which results in a narrow and almost monaural sound image. Many people do not like wearing headphones, especially for long periods of time, because the headphones may cause physical discomfort to the user. For example, headphones may cause permanent pressure on the ear canal or on the pinna as well as fatigue of the muscles supporting the cervical spine. Therefore, wearable loudspeaker devices 300 are known which can be worn around the neck or on the shoulders, as is exemplarily illustrated in FIG. 37. FIG. 37 *a*) schematically illustrates a wearable loudspeaker device 300. The wearable loudspeaker device 300 comprises four loudspeakers 302, 304, 306, 308 in the example of FIG. 37. FIG. 37 *b*) schematically illustrates a user 2 who is wearing the wearable loudspeaker device 300. As can be seen, two of the loudspeakers 302, 304 are arranged such that they provide sound primarily to the right ear of the user 2, while the other two loudspeakers 304, 306 provide sound primarily to the left ear of the user 2. Such a wearable loudspeaker device 300, for example, may be flexible such that it can be brought into any desirable shape. A wearable loudspeaker device 300 may rest on the neck and the shoulders of the user 2. This, however, is only an example. A wearable loudspeaker device 300 may also be configured to only rest on the shoulders of the user 2 or may be clamped around the neck of the user 2 without even touching the shoulders. Any other location or implementation of a wearable loudspeaker device 300 is possible. To allow a wearable loudspeaker device 300 to be located in close proximity of the ears of the user 2, the wearable loudspeaker device may be located anywhere on or close to the neck, chest, back, shoulders, upper arm or any other part of the upper part of the user's body. Any implementation is possible in order to attach the wearable loudspeaker device 300 in close proximity of the ears of the user 2. For example, the wearable loudspeaker device 300 may be attached to the clothing of the user or strapped to the body by a suitable fixture.

Figure 38:
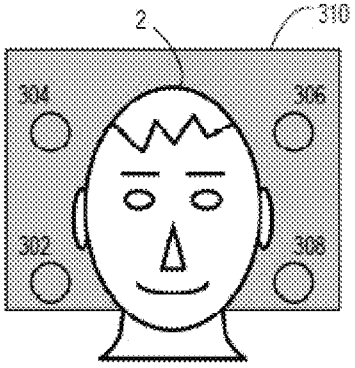

As is schematically illustrated in FIG. 38, the loudspeakers 302, 304, 306, 308 may also be included in a headrest 310, for example. The headrest 310 may be the headrest 310 of a seat, car seat or armchair, for example. Similar to the wearable loudspeaker device 300 of FIG. 37, some loudspeakers 302, 304 may be arranged on the headrest 310 such that they primarily provide sound to the right ear of the user 2, when the user 2 is seated in front of the headrest 310. Other loudspeakers 306, 308 may be arranged such that they primarily provide sound to the left ear of the user 2, when the user 2 is seated in front of the headrest 310.

Figure 36:
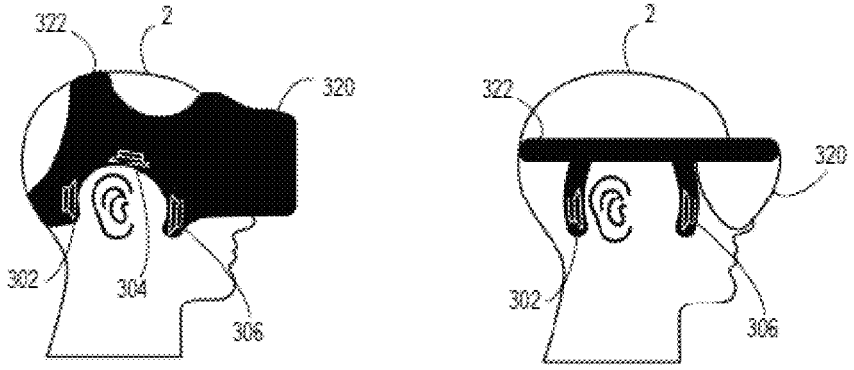
FIGS. 36 to 38 illustrate different exemplary applications in which the method and headphone arrangements may be used.

As is schematically illustrated in FIG. 36, a loudspeaker arrangement may also be included in virtual reality VR or augmented reality AR headsets. For example, such a headset may include a support unit 322. A display 320 may be integrated into the support unit 322. The display 320, however, may also be a separate display 320 that may be separably mounted to the support unit 322. The support unit may form a frame that is configured to form an open structure around the ear of the user 2. The frame may be arranged to partly or entirely encircle the ear of the user 2. In the examples of FIG. 36, the frame only partly encircles the user's ear, e.g., half of the ear. The frame may define an open volume about the ear of the user 2, when the headset is worn by the user 2. In particular, the open volume may be essentially open to a side that faces away from the head of the user 2. At least two sound sources 302, 304, 306 are arranged along the frame of the support unit 322. For example, one front sound source 306 may be arranged at the front of the user's ear, one rear sound source 302 may be arranged behind the user's ear and, optionally, one top sound source 304 may be arranged above the user's ear.

The at least two sound sources 302, 304, 306 are configured to emit sound to the ear from a desired direction (e.g., from the front, rear or top). One of the at least two sound sources 302, 304, 306 may be positioned on the frontal half of the frame to support the induction of natural directional cues as associated with the frontal hemisphere. At least one sound source 302 may be arranged behind the ear on the rear half of the frame to support the induction of natural directional cues as associated with the rear hemisphere. When arranging the at least one sound source 302, 304, 306 on the frontal half of the frame, the sound source position with respect to the horizontal plane through the ear canal does not necessarily have to match the elevation angle ν of the resulting sound image. An optional sound source 304 above the user's ear, or user's pinna, may improve sound source locations above the user 2.

The support structure 322 may be a comparably large structure with a comparably large surface area which covers the user's head to a large extent (left side of FIG. 36). However, it is also possible that the support structure 322 resembles eyeglasses with a ring-shaped structure (frame) that is arranged around the user's head and a display 320 that is held in position in front of the user's eyes (right side of FIG. 36). The frame of the support structure 322 may include extensions, for example, that are coupled to the support structure 322, wherein a first extension extends from the ring-shaped support structure in front of the user's ear and a second extension extends from the ring-shaped support structure behind the user's ear. A section of the ring-shaped support structure may form a top part of the frame. One sound source 306 may be arranged in the first extension to provide sound to the user's ear from the front. A second sound source 302 may be arranged in the second extension to provide sound to the user's ear from the rear. These, however, are only examples. Virtual or augmented reality headsets with integrated sound sources that are suitable for combination with the signal processing methods proposed herein may have any suitable shapes and sizes.

Figure 34:
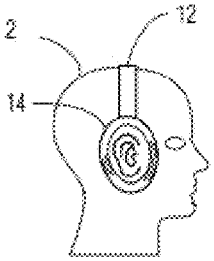
FIG. 34 schematically illustrates a headphone arrangement with an open ear cup.
Figure 35:
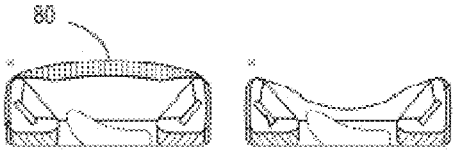
FIG. 35 schematically illustrates an ear cup with and without a cover.

The signal processing methods are also suitable to be used for headphone arrangements, as is schematically illustrated in FIG. 34. A headphone arrangement may include ear cups 14 that are interconnected by a headband 12. The ear cups 14 may be either open ear cups 14 as illustrated in FIG. 34, or closed ear cups (illustrated, for example, in FIG. 35, example a), with a cover 80). One or more loudspeakers 302, 304, 306 are arranged on each ear cup 14. A cover or cap 80 may either be mounted permanently to the ear cup 14 or may be provided as a removable part that may be attached to or removed from the ear cup 14 by a user. The cover 80 may be configured to provide reasonable sealing against air leakage, if desired. Covers 80 may be used for ear cups 14 that completely encircle the ear of the user 2 as well as for ear cups 14 that do not have a continuous circumference. FIG. 35 schematically illustrates an example of a cover 80 for an ear cup 14. The ear cup 14 of FIG. 34 comprises two sound sources 304, 306 in front of the pinna and one sound source 302 behind the pinna. FIG. 35 illustrates a cross-sectional view of an ear cup that is similar to the ear cup 14 of FIG. 34 with the cover 80 mounted thereon (left side) and with the cover 80 removed from the ear cup 14 (right side).

The present disclosure relates to signal processing methods that improve the positioning of virtual sound sources in combination with appropriate directional pinna cues produced by natural pinna resonances. Natural pinna resonances for the individual user may be generated with appropriate loudspeaker arrangements, as has been described above. However, generally the proposed methods may be combined with any sound device that places sound sources close to the user's head, including but not limited to headphones, audio devices that may be worn on the neck and shoulders, virtual or augmented reality headsets and headrests or back rests of chairs or car seats.

Figure 4:
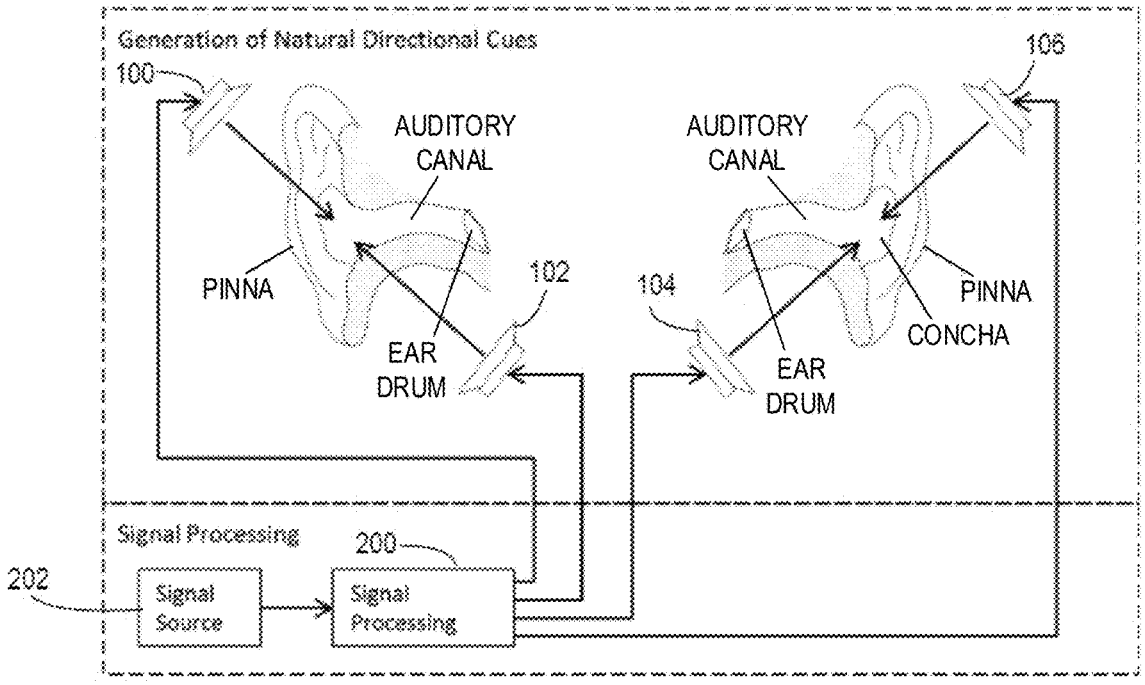
FIG. 4 schematically illustrates a loudspeaker arrangement for generation of natural directional pinna cues that is combined with suitable signal processing.

FIG. 4 schematically illustrates a loudspeaker arrangement. The loudspeaker arrangement is configured to generate natural directional pinna cues. The natural directional pinna cues are combined with suitable signal processing. The structure of the human ear is schematically illustrated in FIG. 4. The human ear consists of three parts, namely the outer ear, the middle ear and the inner ear. The ear canal (auditory canal) of the outer ear is separated from the air-filled tympanic cavity (not illustrated) of the middle ear by the ear drum. The outer ear is the external portion of the ear and includes the visible pinna (also called the auricle). The hollow region in front of the ear canal is called the concha. First loudspeakers 100, 102 are arranged close to one ear of a user (e.g., the right ear), and second loudspeakers 104, 106 are arranged close to the other ear of the user (e.g., the left ear). The first and second loudspeakers 100, 102, 104, 106 may be arranged in any suitable way to generate natural directional pinna cues. The first and second loudspeakers 100, 102, 104, 106 may further be coupled to a signal source 202 and a signal processing unit 200. By further providing signal processing within the analog or the digital domain, the positioning of virtual sound sources may be further improved as compared to an arrangement solely providing natural directional pinna cues without further signal processing. While especially the centered frontal sound image can be improved as compared to known methods, all processing methods that are disclosed herein are capable of positioning virtual sound sources at the typical positions of 5.1 and 7.1 surround sound formats, for example. These typical positions have been described by means of FIG. 3 above. At least one embodiment of the proposed methods may even position virtual sources on a plane all around the user, provided that appropriate natural directional cues from the pinnae are available that suit the desired virtual source position. Another embodiment supports virtual source positioning in 3D space around the user.

For the proposed processing methods it is generally preferred, but not required, that they are used in combination with loudspeakers or loudspeaker arrangements that are configured to generate natural directional pinna cues. Such loudspeakers or loudspeaker arrangements may further induce insignificant directional cues related to head shadowing, other body reflections except reflections caused by the pinna (e.g. shoulder), or room reflections. Insignificant directional cues of this sort are usually generated if the loudspeaker arrangement mainly supplies sound individually to each of the ears. Within this document it is assumed that pinna cues are mainly induced separately for each ear. This means that acoustic cross talk to the other ear is at least 4 dB below the direct sound, preferably even more than 4 dB. If other considerable directional cues, besides pinna cues, are present from the loudspeaker arrangement that may, for example, be caused by acoustic crosstalk from the loudspeaker or loudspeaker arrangement (intended for generation of natural directional pinna cues for one ear) to the other ear, these cues may complement the pinna cues with respect to their associated source direction. In this case the additional cues may even be beneficial if the source angles on the horizontal and median plane promoted by the loudspeaker arrangement are not too far off from the intended angles for virtual sources.

In the presence of natural directional cues from the loudspeaker arrangement that contradict the intended virtual source positions, location and stability of virtual source positions achieved with the processing methods described below may suffer depending on the intensity of the contradicting directional cues. Overall, however, the results obtained by combining the processing methods described below and these kinds of directional pinna cues may still be found worthwhile.

The proposed processing methods may be combined with arrangements for generating natural directional pinna cues, irrespective of the way these cues are generated. Therefore, the following description of the processing methods mostly refers to directions associated with natural pinna cues rather than to loudspeakers or loudspeaker arrangements that may be used to generate these cues. If a loudspeaker or loudspeaker arrangement for generation of directional cues that are associated with a single direction supplies sound to both ears, the pinna cue and, therefore, also the loudspeaker or loudspeaker arrangement is assigned to the ear that receives higher sound levels. If both ears are supplied with approximately equal sound levels by a single loudspeaker or loudspeaker arrangement without individual control over sound levels per ear, the pinna cues are associated with source directions in the median plane and may be utilized to support generation of virtual sources in or close to the median plane.

Loudspeakers or sound sources that are arranged in close proximity to the head generally produce a partly externalized sound image. Partly externalized means that the sound image comprises internal parts of the sound image that are perceived within the head as well as remaining external parts of the sound image which are arranged extremely close to the head. Some users may already perceive a tendency for a frontal center image for stereo content or mono signals if playback loudspeakers are arranged close to the head in a way as to provide frontal directional cues. However, the sound image is often not distinctively separated from the head. To further externalize the sound image, thereby shifting the sound image further towards the desired direction in front of the user's head, signal processing methods that are based on generalized head related transfer functions (HRTF) may be used. The frontal center image on the frontal intersection between the median plane and the horizontal plane usually is of special interest due to the challenges to create a stable sound image in this region, as has been described above. Several processing methods with various degrees of HRTF generalization will be described below. The individual processing methods will generally be grouped within three overall methods, namely a first processing method, a second processing method and a third processing method, which all rely on the same basic principles and all facilitate the generation of virtual sound sources. According to one example, the three overall methods combine natural directional pinna cues that are generated by a suitable loudspeaker or sound source arrangement with generalized directional cues from human or dummy HRTF sets to externalize and to correctly position the virtual sound image. Known methods for virtual sound source generation, for example, apply binaural sound synthesis techniques, based on head related transfer functions to headphones or near field loudspeakers that are supposed to act as replacement for standard headphones (e.g., "virtual headphones" without directional cues). All methods that are described herein utilize natural directional pinna cues induced by the loudspeakers to improve sound source positioning and tonal balance for the user. Further processing methods are described for improving the externalization of the virtual sound image, and for controlling the distance between the virtual sound image and the user's head as well as the shape of the virtual sound image in terms of width and depth.

A first processing method, as disclosed herein, is, for example, very well suited for generating virtual sources in the front or back of the user in combination with natural directional pinna cues associated with front and rear directions. The method offers low tonal coloration and simple processing. The method, therefore, works well together with playback of stereo content, because HRTF-processed stereo playback usually gets lower preference ratings from users than unprocessed stereo, due to tonality changes induced by full HRTF processing. Using the first processing method for precise positioning of virtual sources on the sides of the user, it may be required that natural directional pinna cues are generated that are associated with the sideward direction. The method, therefore, may not be the first choice if virtual sources from the side are desired, but natural directional cues from the sides are not available. It is, however, possible to generate virtual sources on the sides, the front and the back of the user by means of a loudspeaker arrangement that only offers directional pinna cues from directions in the front and the back of the user, if the directions associated with the natural pinna cues produced by the loudspeaker arrangement are well positioned.

Figure 5:
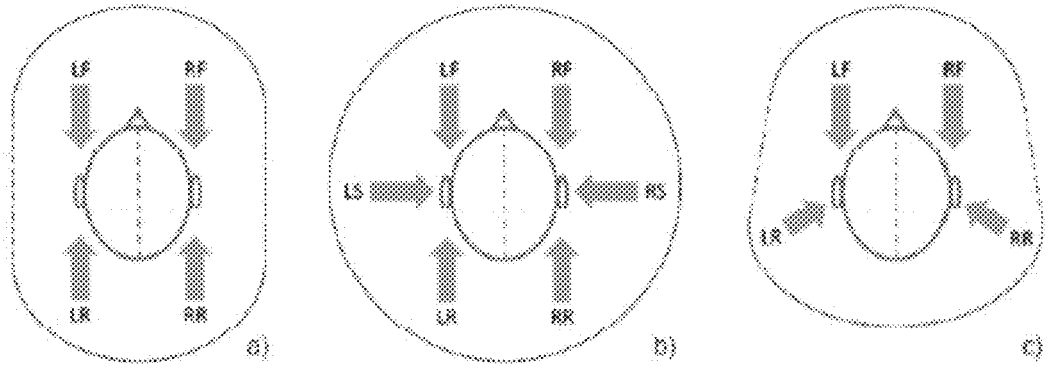
FIG. 5 schematically illustrates different directions that are associated with respective natural pinna cues and respective paths of possible virtual source positions around the user's head.

FIG. 5 schematically illustrates different directions as associated with respective natural pinna cues (left front LF, right front RF, etc., indicated with arrows) and the respective paths of possible virtual source positions around the user's head that the first processing method tends to produce when combined with these pinna cues (indicated with continuous and dashed lines). In FIG. 5 *a*), a pair of frontal directional cues (left front LF, right front RF) and a pair of directional cues from the back (left rear LR, right rear RR) are available. With these pinna cues the first proposed processing method tends to generate well defined virtual sources in front and behind the user (indicated in continuous lines) with closer and less well defined source positions on the side of the user (indicated with dashed lines). The positioning of virtual sources can be improved with a loudspeaker arrangement that offers natural pinna cues for the directions shown in FIG. 5 *b*). The generation of additional pinna cues from the sides (left side LS, right side RS) usually requires additional loudspeakers and cannot be implemented for certain loudspeaker arrangements without destructing frontal and rear pinna cues. Therefore, it is possible to improve the virtual source directions for the rear channels of popular surround sound formats with the natural pinna cue directions illustrated in FIG. 5 *c*). In the example of FIG. 5 *c*), the directional cues from the back (LR, RR) are provided at a certain angle with respect to the median plane. For example, $130° < \varphi < 180°$, $150° < \varphi < 180°$, or $170° < \varphi < 180°$, wherein $\varphi$ is the azimuth angle. Other angles are also possible. It should, however, be noted that source direction paths around the user's head, as illustrated in FIG. 5, merely represent a general tendency and should not be understood as fixed positions. Variations for individual users are generally inevitable. Especially the image width and the image distance may be adjusted by signal processing to be well suited for frontal and rear sound images. However, in general the first processing method proposed herein may be less tolerant to the directions of natural pinna cues than other processing methods also proposed herein. Other methods may be better suited for positioning virtual sources all around the user with a small set of available natural pinna cue directions.

All three examples a), b) and c) of FIG. 5 illustrate a pair of frontal cues (left front LF, right front RF), as it is required for a stable front image localization. The probably best direction is directly from the front (azimuth angle $\varphi=0°$), because virtual sources from the front are usually the most difficult to generate. If virtual sources from the front, sides or back are not required, the respective directional pinna cues are also not necessarily needed. This may, for example, be the case for stereo playback with only a frontal stage or only rear channel playback for combination with an external loudspeaker system that reproduces frontal channels of surround sound formats. If only a pure frontal or rear sound image is generated or wanted, the loudspeakers that produce natural pinna cues for the opposing hemisphere might still be used for the generation of realistic room reflections, because loudspeaker devices positioned close to the ears tend to provide little room excitation due to the dominant signal levels of the direct sound. Furthermore, the sound fields generated by loudspeaker arrangements for the generation of opposing natural directional pinna cues may be mixed by signal distribution over the respective loudspeakers or loudspeaker arrangements to modify or weaken the cues from individual loudspeaker arrangements. This can, for example, help to improve virtual source positions from the side in the presence of natural directional pinna cues only from the front and/or back of the user.

Figure 6:
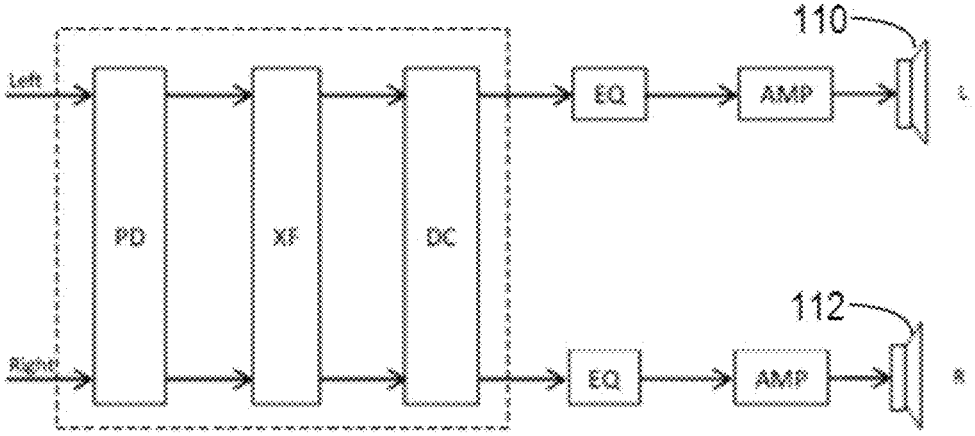
FIG. 6 schematically illustrates a signal processing arrangement.

FIG. 6 schematically illustrates a loudspeaker arrangement. The loudspeaker arrangement comprises a first loudspeaker or loudspeaker arrangement 110 and a second loudspeaker or loudspeaker arrangement 112. Each loudspeaker or loudspeaker arrangement 110, 112 may be configured to generate natural directional pinna cues for a sound source position in the front (e.g., see LF, RF in FIG. 5) or at the back (e.g., see LR, RR in FIG. 5) of the user. The natural directional pinna cues generated by the two loudspeakers or loudspeaker arrangements 110, 112 may possess largely identical distances and elevation angles $\nu$ as well as corresponding azimuth angles $\varphi$ that are symmetrical to the median plane. The virtual sources created by the loudspeaker arrangements, therefore, are essentially positioned symmetrically with respect to the median plane if a mono signal is provided over the loudspeaker arrangements without further processing such that both loudspeaker arrangements radiate an identical acoustic signal. For example, natural pinna cues associated with the frontal hemisphere may be employed to generate virtual sound sources in the front of the user which may be required for the left and right speaker of traditional stereo playback or the center speaker of common surround sound formats. It is also possible to employ natural pinna cues associated with the back of the user, which may be used to generate virtual sources behind the user, which may be required for the surround or rear channels of many surround sound formats. It is important to note that the source directions associated with the natural pinna cues generated by the utilized loudspeaker arrangements and the desired virtual source positions don't need to exactly match each other, as has already been described above.

Especially the azimuth angle $\varphi$ may be controlled to a large extent by means of signal processing. The elevation angle $\nu$ may be at least approximately similar to the intended elevation angle $\nu$ for the signal processing arrangement illustrated in FIG. 6. The proposed first processing method generally does not substantially alter the perceived elevation angle. Especially pinna cues from the back of the ear do not need to match the azimuth angle $\varphi$ of the intended virtual sources (e.g. preferred positions of surround or rear channels for surround sound formats). Pinna cues from the back may generally take any position behind the user, preferably not substantially closer to the median plane than the desired virtual sound source positions, as long as the elevation angle $\nu$ for the positions associated with the natural pinna cues is close to the desired elevation angle $\nu$ of the virtual sources. Large deviations between a desired virtual source elevation angle $\nu$ and the elevation angle $\nu$ associated with the natural directional pinna cues may lead to a shift of the virtual source elevation angle $\nu$ towards the elevation angle $\nu$ of the pinna cues.

In the arrangement that is illustrated in FIG. 6, the main processing steps for virtual source positioning are framed by a rectangle in a dashed line. In a first step, phase decorrelation PD may be applied between the input audio signals (Left, Right) for the left loudspeaker (first loudspeaker) 110 and the right loudspeaker (second loudspeaker) 112 to widen the perceived angle between two virtual sound sources on the left and the right side. In a next step, HRTF-based crossfeed XF is applied to the de-correlated signals to externalize the sound image and control the azimuth angles $\varphi$ of the virtual sources. As phase decorrelation PD and crossfeed XF both influence the angle between the virtual sources or the auditory source width for stereo playback, they can be combined to achieve the desired result. To control the distance of the virtual sources from the user's head, artificial reflections may be applied in a distance control DC block. Implementation options for each of these processing blocks are discussed below. Before each signal is amplified AMP before being provided to the loudspeakers 110, 112, equalizing EQ may be applied to compensate the loudspeaker amplitude response to gain the desired tonality and frequency range from the loudspeaker. Amplifying and equalizing, however, are optional steps and may be omitted.

Different possibilities for implementing phase de-correlation are known. By means of phase de-correlation, the inter channel time difference (ICTD) in a pair of audio signals may be varied, for example. For example, filters with inverse phase response that vary the phase of a signal over the frequency in a deterministic way (positive and negative cosine contour) may be applied to the first and second audio input signal (Left, Right) for a controlled de-correlation of the phase or the time delay between the channels over frequency. It should be noted that it is generally possible to apply phase de-correlation using multiple consecutive FIR (finite impulse response) or IIR (infinite impulse response) allpass filters, each designed with a different frequency period $\Delta f$ and peak phase shift value $\tau$ to achieve better effects with less artifacts. Furthermore, low frequencies may be excluded from phase de-correlation, to achieve good results for signal summation in the acoustic domain where available sound pressure levels are often lower than desired. Even further, de-correlation in some examples may only be applied to the in-phase part of the left and right signal, because signals that are panned to the sides usually are already highly de-correlated. The described phase de-correlation method, however, is only an example. Any other suitable phase de-correlation method may be applied without deviating from the scope of the disclosure.

Figure 7:
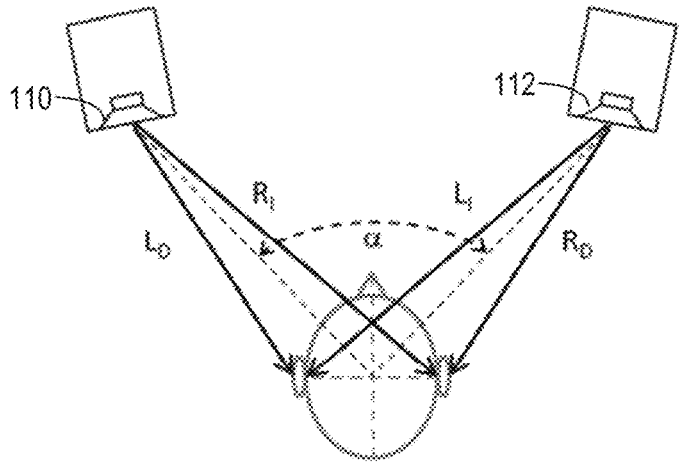
FIG. 7 schematically illustrates direct and indirect transfer functions for the left and right ear of a user.
Figure 8:
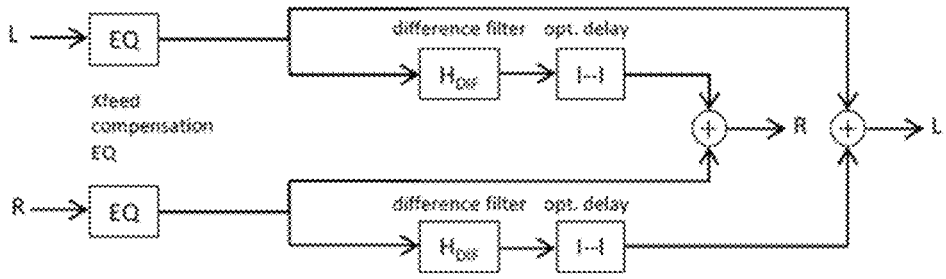
FIG. 8 schematically illustrates a crossfeed signal path.

If the filter that is applied to the crossfeed signals is derived from human or dummy HRTFs, the application of such crossfeed can be seen as the application of generalized HRTFs (head related transfer functions). As illustrated in FIG. 7, a pair of head related transfer functions (left direct $L_D$ and right indirect $R_I$, or right direct $R_D$ and left indirect $L_I$) exists for each sound source direction. One for the direct sound received with the receiving ear on the same side as the sound source 110, 112 ($L_D$ and $R_D$) and another for indirect sound received with the opposite ear on the opposite side than the sound source 110, 112 ($L_I$ and $R_I$). Each HRTF pair comprises characteristics that are largely identical for the direct and the indirect signal path. The characteristics, for example, may be influenced by pinna resonances in response to the elevation angle $\nu$ of the sound source 110, 112, the measurement equipment or even the room response if the measurements are not performed in an anechoic environment. Other characteristics may be different for the direct and indirect HRTFs. Such differences may be mainly caused by head shadowing effects between the left and the right ear which may result in frequency-dependent phase and amplitude alterations. The difference transfer function $H_{DIF}$, which represents the difference between direct ($HL_D$, $HR_D$) and indirect ($HL_I$, $HR_I$) transfer functions in the frequency domain, may be averaged for two sound sources that are positioned symmetrically with respect to the median plane (see equation 5.1 below and FIG. 7) and may be applied to crossfeed paths between left and right side signals as illustrated in FIG. 8 (difference filter, $H_{DIF}$). As the common characteristics of direct and indirect HRTFs are not applied to the signal, sound colorations are reduced as compared to the application of the complete HRTF set.

$$H_{DIF}=(HR_I/HL_D+HL_I/HR_D)/2 \quad (5.1)$$

Furthermore, the crossfeed signal may be influenced by a foreign pinna, for example the pinna of another human or a dummy from which the HRTF was taken, to a lesser extent. This is because the pinna resonances generated by a sound source depend significantly on the source elevation angle, although they are not completely identical for both ears. This may be beneficial, because natural pinna resonances will be contributed by the loudspeaker arrangement.

To reduce the processing requirements, the amplitude response of the difference filter with the difference transfer function $H_{DIF}$ may be approximated by minimum phase filters and the phase response may be approximated by a fixed delay. According to other examples, the phase response may be approximated by allpass filters (IIR or FIR). In that case, the optional delay unit (I-I), as illustrated in FIG. 8, is not required. As is schematically illustrated in FIG. 8, the left signal L is filtered and added to the unfiltered right signal R, resulting in a processed right signal. The filtered right signal R is added to the unfiltered left signal L, resulting in a processed left signal.

To generalize the difference filters, the difference transfer function $H_{DIF}$ may be averaged over a large number of test subjects, for example. Due to their relatively high q-factor and individual position, pinna resonances are largely suppressed by averaging of multiple HRTF sets, which is positive because natural individual pinna resonances will be added by the loudspeaker arrangement. Furthermore, non-linear smoothing, which applies averaging over a frequency-dependent window width, may be carried out on the amplitude response of the difference transfer function $H_{DIF}$ to avoid sharp peaks and dips in the amplitude response which are typical for pinna resonances. Finally, amplitude response approximation by minimum phase filters may be controlled to follow the overall trend of the difference transfer function $H_{DIF}$ to avoid fine details. As the generation of the crossfeed filter transfer function already suppresses the foreign pinna cues, the further combination with averaging over multiple HRTF sets, smoothing and coarse approximation may virtually remove all foreign pinna cues.

As is illustrated in FIG. 8, sound colorations that are caused by comb filter effects induced by the crossfeed signal may be compensated by partly equalizing the signals prior to filtering them (see equalizing unit EQ in FIG. 8). Another possibility is to perform the equalizing downstream of the crossfeed application (not illustrated in FIG. 8). Comb filter effects generally depend on signal correlation between left and right side signal. Therefore, comb filter effects for correlated signals may only be compensated partly to avoid adverse effects for uncorrelated signals. Equalizing may, for example, be carried out with partly correlated noise played over left and right channels (L, R in FIG. 8).

Depending on the source angle $\alpha$ between the sources 110, 112 that are utilized to measure the HRTF sets (FIG. 8), the positions of the virtual sources generated by left and right side channel playback and, thereby, the stereo width or auditory source width will be altered. The source angle $\alpha$, therefore, may be adjusted to the desired stereo width. While this can be done with good spatial effect, the comb filter caused by a high phase shift or a delay in the crossfeed path for correlated left and right side signals will induce considerable tonality changes to the signals. If the amplitude response is kept identical to the amplitude response that is provided by the HRTF set with the desired virtual source angles, but the phase shift or delay in the crossfeed path is reduced significantly, the stereo width is also reduced, but comb filters start at increasingly higher frequencies and with lower Q-factor. This may make them easier to equalize with low adverse effect for uncorrelated signals. The narrow auditory sound width resulting from the short crossfeed delay may be at least partly compensated by phase de-correlation as described above. HRTF sets from the back of the user may be employed for the generation of virtual sources behind the user and HRTF sets from the front may be employed for generation of virtual sources in front of the user. In both cases, the reduction of the crossfeed delay and a subsequent source width compensation by means of phase de-correlation is possible, as has been described before. However, it has been found that the crossfeed filter function determined from the HRTF sets of frontal sources may also be applied to generate virtual sources in the back of the user, and vice versa, if combined with appropriate natural directional pinna cues, because head shadowing effects are largely comparable for source positions at the front and back and the filter functions generally are not overly critical for source positioning.

Applying HRTF-based crossfeed as described above, the sound image is externalized for most users and, thereby, pushed further away from the head towards its original direction. If the original direction was on the front, promoted by natural directional pinna cues from the front, the image will be pushed further to the front. If natural directional pinna cues from the back are applied by a suitable loudspeaker arrangement, the sound image will be shifted further to the back by application of HRTF-crossfeed.

Figure 10:
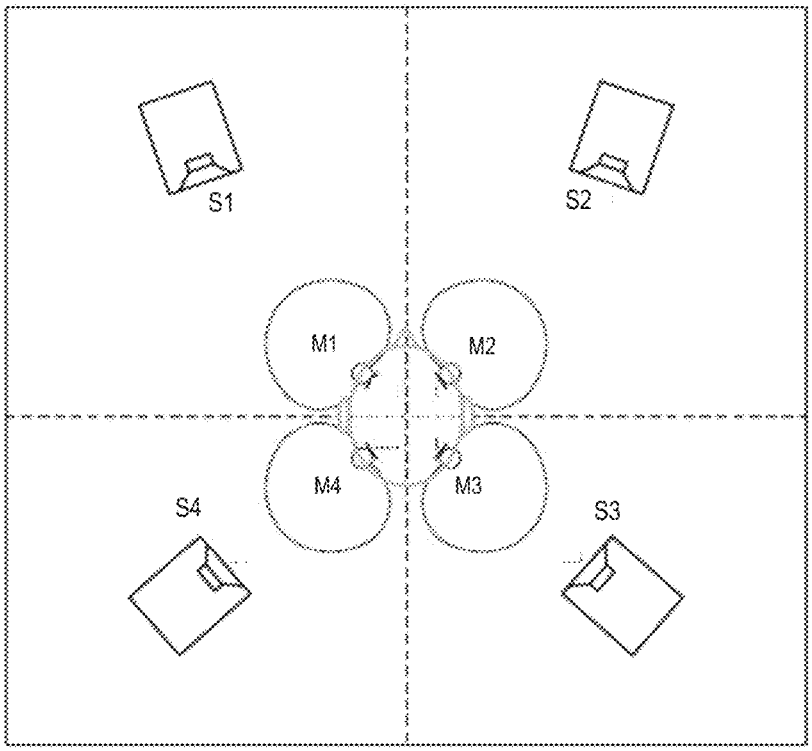
FIG. 10 schematically illustrates an arrangement for performing room impulse measurements.

To control the distance of virtual sound sources as perceived by the user, artificial room reflections may be added to the signal that would be generated by loudspeakers within a predefined reference room at the desired position of the virtual sources. Reflection patterns may be derived from measured room impulse responses, for example. Room impulse measurements may be carried out using directional microphones (e.g., cardioid), for example, with the main lobe pointing towards the left and right side quadrants in front and at the back of a human or a dummy head. This is schematically illustrated in FIG. 10. In FIG. 10, a dummy head is positioned in the center of a room. The room is divided in four equal quadrants. One sound source S1, S2, S3, S4 is positioned within each of the quadrants. The main direction of sound propagation of each of the sound sources S1, S2, S3, S4 is directed towards the dummy head. The main direction of sound propagation of the sound sources S2, S3 that are arranged in the two right quadrants (top right, bottom right) is directed towards the right ear of the dummy head. The main direction of sound propagation of the sound sources S1, S4 that are arranged in the two left quadrants (top left, bottom left) is directed towards the left ear of the dummy head. One microphone M1, M2, M3, M4 is arranged in each quadrant close to the dummy head's ears. For example, one microphone M1 is arranged in the top left quadrant at a certain distance in front of the dummy head's left ear and a further microphone M4 is arranged in the bottom right quadrant at a certain distance behind the dummy head's left ear. The same applies for the right ear of the dummy head.

Figure 9:
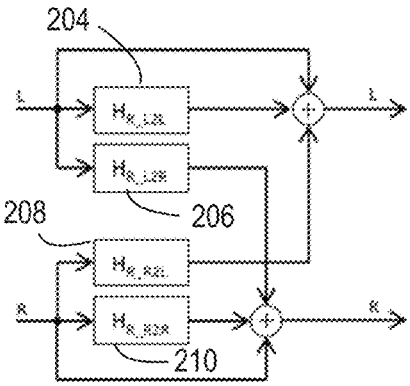
FIG. 9 schematically illustrates a signal path for the application of room reflections for controlling the source distance and reverberation.

The performing of such measurements allows a coarse separation of incidence angles for reflected sounds. Alternatively, reflection patterns may be simulated using room models that may also include cardioid microphones as sound receivers. Another option is to utilize room models with ray tracing that allow precise determination of incidence angles for all reflections. In any case, it may be beneficial to split the reflections with respect to the source position and incidence angle into a left side and a right side and add the reflections to the respective audio channel. This is schematically illustrated in FIG. 9, where reflections that are generated by the source on the left side are added to the left channel signal if their incidence angle falls into the left hemisphere (first processing block 204 with transfer function $H_{R_L2L}$). Reflections generated by the source on the left side are added to the right channel R if their incidence angle falls into the right hemisphere (second processing block 206 with transfer function $H_{R_L2R}$). Reflections from the source on the right side are handled accordingly (third and fourth processing blocks 208, 210 with transfer functions $H_{R_R2L}$ and $H_{R_R2R}$, respectively). HRTF-based processing may be applied to the reflections in accordance with their incidence angle to further enhance spatial representation, for example. During the generalization of HRTF sets, pinna resonances may be suppressed, for example, by averaging or smoothing the amplitude response.

It should be noted that all transfer functions that are illustrated in FIG. 9 only contain the reflected part of the room impulse response. Therefore, the direct sound is not affected. The transfer functions illustrated in FIG. 9 may, for example, be applied to the respective signal by means of finite impulse response filters (FIR). This may be convenient, because measured room impulse responses may be converted to suitable filter sets with little effort. To avoid alterations of the direct sound, the part of the impulse response that contains the first dominant peak associated with the direct sound may be suppressed. It is also possible to implement reflection models based on delay lines and filters for absorption coefficients and incidence angle, for example.

Besides the possibility of controlling the perceived distance, artificial room reflections also allow for generating a natural reverberation, as would be present for loudspeakers that are placed in a room. The room impulse response may be shaped for late reflections (e.g. >150 ms) to gain pleasant reverberation. Furthermore, the frequency range for which reflections are added may be restricted. For example, the low frequency region may be kept free of reflections to avoid a boomy bass.

The equalizing block EQ in FIG. 6 is predominantly applied for controlling tonality, frequency range and time of sound arrival for the loudspeaker arrangements utilized to generate sound with natural directional pinna cues. It should, however, be mentioned that the perception of sources in the front or the back may be supported by boost and attenuation in certain frequency bands, also known as directional bands. Modern portable audio equipment is often equalized in a way that boosts the frequency bands of frontal perception, e.g., around 315 Hz and 3.15 kHz, and many users today are used to this kind of linear distortion. To increase the effect of the natural pinna resonances, such an equalizing may be applied especially to generate sources in front of the user. A combination with attenuation at around 1 kHz and 10 kHz further improves the effect, but the main focus may be on a pleasant tonality, because tonality is usually more important for users than spatial representation. For the generation of virtual sources behind the user, the boost and attenuation of directional bands may be inverse to the case of frontal sources. However, as the directional bands are generally based on pinna resonance and cancellation effects, their position varies for different individuals. Furthermore, the directional cues are already present in the natural directional pinna cues that may be generated by suitable loudspeaker or sound source arrangements. Therefore, additional equalizing based on directional bands should be applied with caution and the main focus may be on pleasant tonality.

Generally, care must be taken that neither the equalizing nor the passive frequency response of the loudspeaker arrangements adversely affect the location of the virtual sources. Therefore, the equalized frequency response should ideally be smooth without any pronounced peaks or dips that are prone to interfere with directional pinna cues. The equalizing should support this as far as possible.

The signal flow illustrated in FIG. 6 only allows to generate the input signal for two loudspeakers or loudspeaker arrangements (L, R) that provide natural directional pinna cues for both ears from either the front, back or sides of the user (e.g., LF and RF or LR and RR or LS and RS in FIG. 5). The signal flow illustrated in FIG. 11, on the other hand, allows to generate input signals for four loudspeakers or loudspeaker arrangements providing two sets of natural directional pinna cues (e.g. LF, RF, LR and RR of FIG. 5). Despite the multiple directions that are supported by the loudspeaker arrangements, the processing signal flow of FIG. 11 supports a two channel input like, for example, stereo or the rear channels of common surround sound formats. The additional loudspeakers or loudspeaker arrangements and their associated directional cues may be utilized to improve low frequency sound pressure levels, provide improved room reflections and allow a shifting of the position of virtual sources between the respective directions of the available sets of natural directional pinna cues (e.g. front and rear). These features are, for example, beneficial for improvement of stereo playback. It generally depends on the supported frequency range of the loudspeaker arrangements in the front and the back which of these features may be implemented. For improvement of low frequency sound pressure level, the loudspeaker arrangements may be configured to support the respective frequency range (e.g. below 150-500 Hz depending on the low frequency extension of the whole system). For additional room reflections and image position shifting, preferably the frequency range above 150 Hz, but at least above 4 kHz is generally required. The full frequency range of the complete loudspeaker system is generally required for all loudspeaker arrangements if all features shall be implemented.

Figure 11:
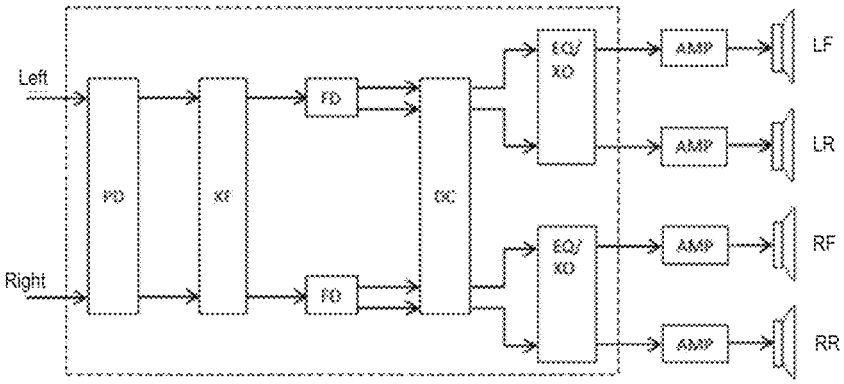
FIG. 11 schematically illustrates a further signal processing arrangement.

The phase de-correlation (PD) and crossfeed (XF) processing blocks in the arrangement of FIG. 11 are essentially identical to the respective phase de-correlation and crossfeed blocks as described before with regard to the arrangement of FIG. 6. The fader blocks (FD) control the signal distribution between loudspeaker arrangements that generate natural pinna cues from the front and back usually with similar front/back distribution per side. In this way, the predominant directional pinna cues are crossfaded between the frontal and rear position provided by the loudspeaker arrangements. Fader blocks FD may be adjusted to shift the virtual sources on both sides between front and back or more general, between the respective directions of the natural pinna cues generated by the frontal and rear loudspeaker arrangements. This may, for example, be used to shift the stereo stage to the front, sides or back of the user. It should be noted that it is also possible to control the elevation of a virtual sound source in the same way if, for example, natural directional pinna cues of two different elevation angles in the front are mixed.

Figure 12:
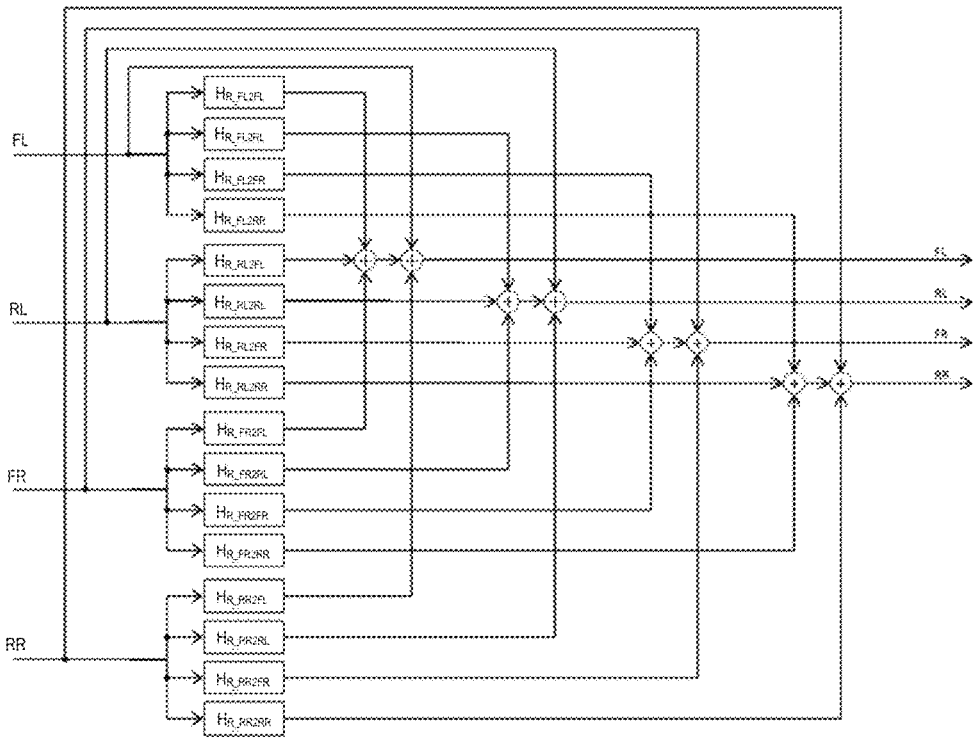
FIG. 12 schematically illustrates a signal flow path for applying room reflections.

Distance control (DC) as employed in FIG. 11, may support four input and output channels. For each input channel reflection signals for all output channels are generated as illustrated in FIG. 12. In analogy to the process described before for the two channel distance control blocks of FIG. 9, the reflections generated by each source position within the reference room are allocated to one of four quadrants (left front, left rear, right front and right rear) based on their incidence angle at the user position and are fed to the respective loudspeaker or loudspeaker arrangement for which the direction associated with the natural pinna cues falls within the respective quadrant. This means that for every input channel FL, RL, FR, RR of the distance control block DC, four transfer functions, e.g., $H_{R_FL2FL}$, $H_{R_FL2RL}$, $H_{L_FL2FR}$, $H_{L_FL2RR}$ for input channel FL, exist for the generation of reflections for all respective output channels. As a result, room reflections from all around the user are generated, thereby allowing better source distance control and even more natural reverberation. The determination options of these transfer functions are the same as for the two channel distance control blocks, as described with regard to FIG. 9. The same applies for the implementation options of the respective signal processing.

It should be noted that the position of the fader block (FD) in the arrangement of FIG. 11 may be shifted further to the input or to the output of the signal flow. If the fader block is moved to behind the distance control (DC) block, for example, the latter may only support two inputs and outputs as described with respect to FIG. 9. For the determination of the transfer functions that are applied for the generation of room reflections, the positions of the loudspeakers within the reference room may reflect the virtual source positions promoted by the natural directional pinna cues that are generated by the given distribution between frontal and rear loudspeaker arrangements. This means that for achieving the best performance for any possible distribution of the fader between acoustic channels, the distance control parameter (e.g. filter coefficients or delays) should be readjusted to match the new position of the virtual source. This may, however, only be acceptable if front/back fading is solely adjusted during product engineering and not accessible for and adjustable by the customer.

Another option is to place the frontal and rear loudspeakers within the reference room during the determination of the transfer functions, in order to generate reflections that are largely symmetrical with respect to the receiving positions (microphones or ears) and the boundaries of the room. In this case, reflections generally are largely equal for all loudspeaker positions which reduces the number of required transfer functions and allows for redistribution between front and rear loudspeaker arrangements without a readjustment of the reflection block. However, generally the alignment of the source position with respect to the user's position within the reference room to the position of the desired virtual sources is not very critical. Therefore, the results may also be satisfying if the fader (FD) is arranged behind the distance control block and reflections are not readjusted for the virtual source positions resulting from fader control.

If the fader block (FD) is positioned directly at the input of the signal flow even before the phase de-correlation block (PD), both the phase de-correlation (PD) and the crossfeed (XF) may be implemented twice. Once for the LF and RF signal pair and once for the LR and RR signal pair. This allows for controlling azimuth angles of the virtual sources and, thereby, the auditory source width individually for front and rear channels for best matching the auditory source width. This may, for example, be required if the natural pinna cues that are generated by the frontal and rear loudspeaker arrangements are associated with largely different azimuth angles. However, as the arrangement of FIG. 11 only supports two input channels (left, right), the matching of front and rear auditory source width may be of minor importance.

The arrangement of FIG. 11 further comprises processing block (EQ/XO) that implements equalizing and crossover functions between the output channels. In principle, equalizing relates to controlling tonality and loudspeaker frequency range, as was the case for the equalizing block EQ of the signal processing arrangement for two loudspeakers or loudspeaker arrangements as illustrated in FIG. 6. The crossover function relates to the signal distribution between loudspeaker arrangements that are utilized for the generation of natural directional pinna cues from the frontal and rear hemisphere.

Figure 13:
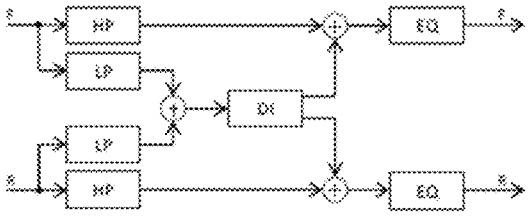
FIG. 13 schematically illustrates details of the signal flow inside the EQ/XO processing blocks of FIG. 11.

FIG. 13 illustrates details of the signal flow inside the EQ/XO processing blocks of FIG. 11. Complementary high-pass (HP) and low-pass (LP) filters are applied to the front and rear channels (F, R). A distribution block (DI) may comprise a crossfader that is configured to distribute the low frequency signal over front and back channel. The distribution may be equal for frontal and rear loudspeaker arrangements, which means that a factor of 0.5 or −6 dB may be applied to the summed low-pass filtered signal before it is added to the high-pass filtered signals of the incoming front and back channels. If front and back loudspeaker arrangements do not provide the same capabilities regarding maximum sound pressure level for the frequencies of interest, the distribution of the low frequency signal may be adapted to the possible contribution of the respective loudspeaker arrangement to the total sound pressure level. If one of the loudspeaker arrangements cannot play the required low frequency range at all, the distribution block may simply distribute the complete signal to the other loudspeaker arrangement. Typical crossover frequencies for the complementary high-pass and low-pass filters are between 150 Hz and 4 kHz. As stated before, it may be desirable to play a wide frequency range preferably above 150 Hz over any loudspeaker arrangement that is intended to generate natural directional pinna cues for a single direction per ear. However, the crossover frequency may be shifted up to 4 kHz while still gaining improved control of virtual sound source location for the frontal hemisphere as compared to loudspeaker arrangements that miss any natural directional cues or even generate directional pinna cues that contradict the desired virtual source location.

The equalizing blocks (EQ) may be required to control the tonality and the frequency range of the respective loudspeaker arrangements in the front and back. Furthermore, acoustic output levels may be largely identical within overlapping frequency bands to allow for bass distribution, front/back fading and distribution of reflections. Largely equal output levels should, therefore, at least be available over the crossover frequency of the complementary high- and low-pass filters for front/back fading and for the distribution of reflections, and should be below the crossover frequency for bass distribution. Finally, the equalizing blocks may also adapt the phase response of the loudspeaker arrangements to improve acoustical signal summation for all those cases in which front and rear loudspeaker arrangements emit the same signal (bass distribution and any middle position of front/back fading).

Figure 14:
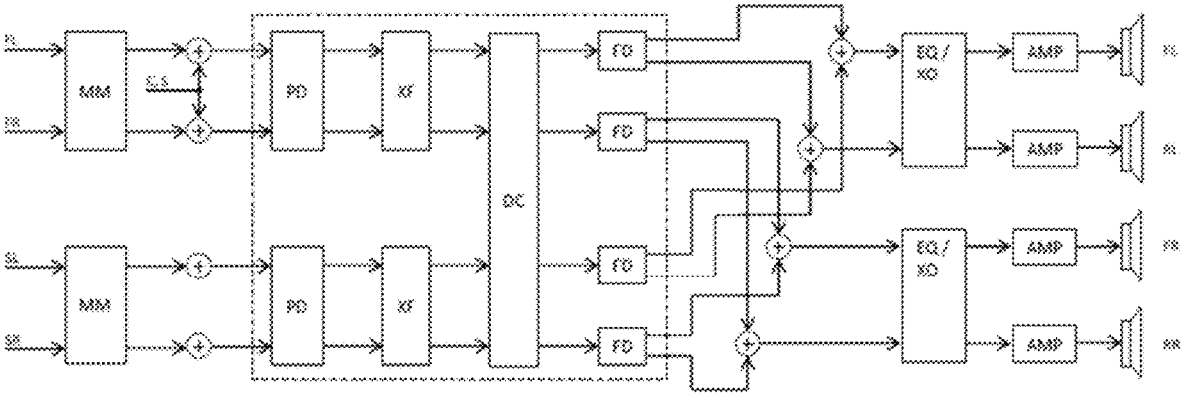
FIG. 14 schematically illustrates a further signal processing arrangement.

If additional input channels are desired that should be played at virtual positions in the front and back of the user, the signal flow arrangement as illustrated in FIG. 14 may be employed. This may, for example, be the case if the channels of 5.1 surround sound formats should be placed at the right positions around the user by means of virtual sources. FIG. 14 schematically illustrates a signal processing arrangement for four loudspeakers or loudspeaker arrangements that create natural directional pinna cues for two source directions per ear that are approximately symmetrically distributed on the left and the right side of the median plane with 4 to 6 channel inputs (e.g. 5.1 surround sound formats).

The signal flow arrangement of FIG. 14 comprises mainly processing blocks that have already been described above with respect to FIGS. 6 and 11. Further, mono mixing (MM) blocks may be provided in the signal flow arrangement on the input side (prior to the phase de-correlation blocks PD) for distributing low frequency parts (e.g. below 80-100 Hz) of the left and right signals equally. This results in an ideal utilization of available volume displacement from all loudspeakers. This is, however, an optional processing step that may also be added to the previously described signal flow arrangements of FIGS. 6 and 11. The center signal (C) is mixed into front left FL and front right FR channels to generate a virtual source between the front left and front right virtual source positions. Distribution between left and right loudspeaker arrangements may be implemented if the sub (S) channel, also known as low frequency effects (LFE) channel, is also mixed onto the front left and front right channels and later distributed over the loudspeaker arrangements that generate natural pinna cues for the frontal and rear hemisphere within the EQ/XO blocks as described before with reference to the signal flow arrangement of FIG. 11. It should be noted that the number of input channels and associated virtual source positions may be increased further. The principles for further increasing the number of input channels are generally based on the same principles for increasing the number of input channels from two, as illustrated in FIG. 11, to four to six input channels, as illustrated in FIG. 14. For example, the rear channels of 7.1 surround formats may be added which basically requires a shorter crossfeed delay in the additional XF block to reduce the auditory source width between the rear surround channels as compared to the surround channels on the side. In that case, the phase de-correlation block PD receives two additional inputs for which it generates reflection signals for all directions of natural pinna cues supplied by the loudspeaker arrangements in the same way as has been described with respect to the four inputs of the phase de-correlation block PD illustrated in FIG. 14.

Phase de-correlation (PD) and crossfeeding (XF) are applied separately for the channels that are intended for front (e.g. front left, (FL) front right (FR) and center) and back (e.g. surround left (SL), surround right (SR)) playback. Azimuth angles and thereby auditory source width may be adjusted independently for front and back as has been described before.

A distance control block (DC) with four inputs and outputs generally generates reflections for virtual source positions on front left and right as well as rear left and right. The function and the working principle of such a distance control block DC are the same as has been described with respect to FIGS. 11 and 12. For further improvement of the center channel image, it may be beneficial to add another virtual source position to the distance control block in front of the listening position. This further virtual source position may generate corresponding room reflections for the center channel which are mixed on all output channels, depending on their incidence angle with respect to the listening position as has been previously described. In that case, the center channel may either be processed by separate PD and XF blocks before it is fed into the distance control block and mixed onto the FL and FR outputs, or phase de-correlation and crossfeed may be avoided for the center channel. In this case, the center channel may be directly fed into the distance control block DC.

Referring to the signal flow arrangement described with respect to FIG. 14, the fader (FD) blocks are arranged behind the distance control block DC. This is, because the fader blocks FD are not configured to shift the image all the way from the front to the back and vice versa, but merely to make minor adjustments of the frontal and rear positions for a good transition between frontal and rear sources. The fader blocks FD are configured to control the dominance of directional cues from front and back and may, therefore, be used to position virtual sources between the front and the back. No adjustments in the distance control block DC are required if the fader blocks FD only result in minor adjustments. Only if a source is positioned far from the front and back positions, corresponding loudspeaker positions for the determination of reflection transfer functions are recommended. The fader blocks FD comprise cross-faders, as has been described before, which control the distribution of the signal between loudspeaker arrangements creating natural directional pinna cues for the front and rear.

EQ/XO blocks may be configured to distribute the signal between loudspeaker arrangements creating natural directional pinna cues for the front and the rear, to control the tonality and frequency extension of the loudspeaker arrangements and to align the time of sound arrival from different loudspeakers or loudspeaker arrangements, as has been described with respect to FIG. 13.

If the loudspeaker arrangements that create the natural directional pinna cues are moving with the user's head (e.g. are attached to the user's head in any suitable way), the stability of virtual source positions may be improved if their location is fixed in space despite and independent from the head movements of the user. This means that, for example, a first source is arranged on the front left side of the user's head, when the user's head is in a starting position (e.g., the user is looking straight ahead). When the user turns his head to the left side (user looking to the left), the first sound source may then be arranged on his right side. This can be achieved by means of dynamic re-positioning of the virtual sources towards the opposite direction of the head movements of the user. This is generally known as head tracking within this context. Head rotations about a vertical axis (perpendicular to the horizontal plane) are usually the most important movements and should be compensated. This is because humans generally use fine rotations of the head to evaluate source positions. The stability of external localization may be improved drastically if the azimuth angles of all virtual sources are adjusted dynamically to compensate for head rotations, even if the maximum rotation angle that can be compensated is comparatively small. For many typical listening scenarios, the user only turns his head within small azimuth angles most of the time. This is, for example, the case when the user is sitting on the couch, listening to music or watching a movie. However, even if the user is walking around, it is usually not desirable that large head movements are compensated. Otherwise, the stage for stereo content could be permanently shifted to the side or to the back of the user when the user turns his head to the side or walks back towards the direction that he came from. Likewise, compensation of source distance is not required for most listening scenarios. Repositioning of sources all around the user, possibly including the source distance, is mainly required for virtual reality environments that allow the user to turn or even to walk around. The head tracking method, as described with respect to the first processing method for virtual source positioning, generally only supports comparatively small rotation angles, depending on the positioning of the virtual sources or, more specifically, the angle between the sources (results are generally worse for larger angles between the sources) and the matching of distance and auditory source width between front and rear sources. Shifts of the azimuth angle of about +/−30° or even more are usually possible with good performance, which is sufficient for most listening situations. The proposed head tracking method is computationally very efficient.

Figure 15:
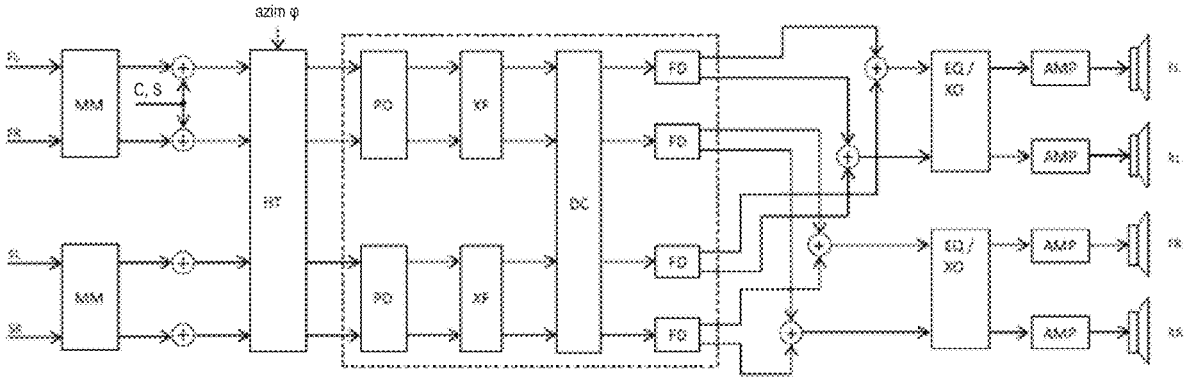
FIG. 15 schematically illustrates a further signal processing arrangement.

FIG. 15 schematically illustrates a signal processing arrangement for four loudspeakers or loudspeaker arrangements that are configured to create natural directional pinna cues for two source directions per ear that are approximately symmetrically distributed on the left and the right side of the median plane with 4 to 6 input channels (e.g. 5.1 surround sound formats) and head tracking. The signal processing arrangement of FIG. 15 essentially corresponds to the signal processing arrangement of FIG. 14. In addition to the processing blocks already included in the arrangement of FIG. 14, the arrangement of FIG. 15 comprises a head tracking (HT) block. The head tracking HT block is configured to implement head tracking or compensation of head rotations by means of a simple panning of the input channels between the nearest neighboring channels regarding the azimuth angle of the respective virtual source position for a clockwise and a counter clockwise rotation. Parts of the possible processing within the head tracking HT block are exemplarily illustrated in FIG. 16, which illustrates a panning matrix for source position shifting. Each channel (e.g. FL) is multiplied with dynamic panning factors (e.g., $S_{CW_FL}$, $S_{REF_FL}$, $S_{CCW_FL}$) that control the distribution between the reference position (e.g. REF_FL) and the next virtual source position in clockwise (e.g. SCW_FL) and counter clockwise direction (e.g. SCCW_FL).

Figure 16:
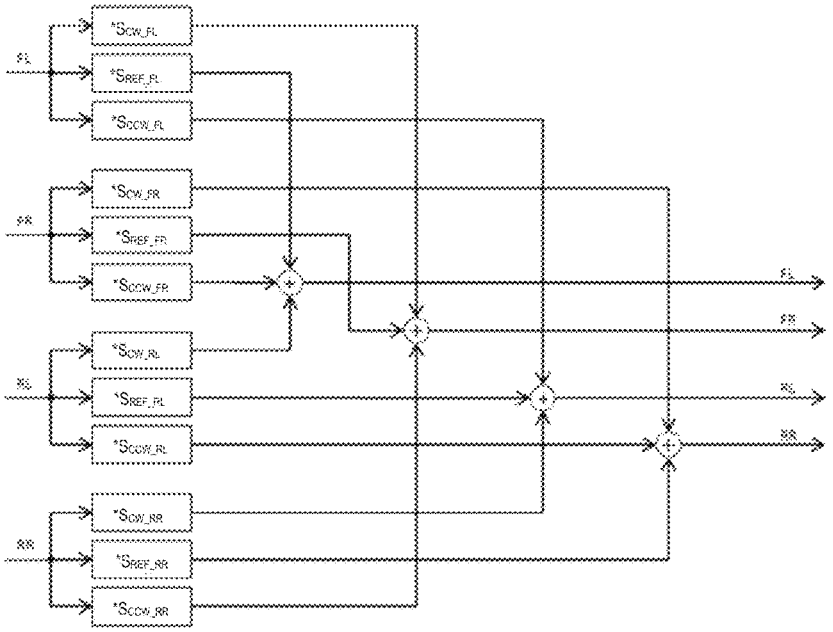
FIG. 16 schematically illustrates a panning matrix for source position shifting.
Figure 17:
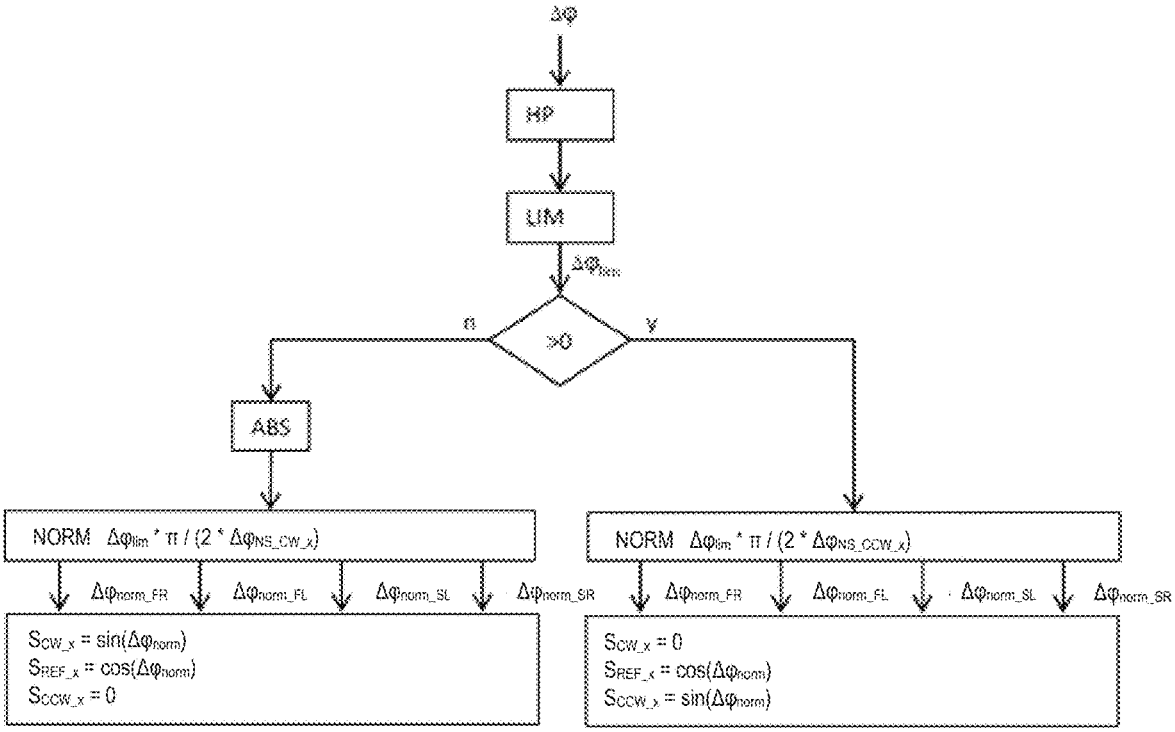
FIG. 17 schematically illustrates a panning coefficient calculation for virtual sources that are distributed on the horizontal plane with variable azimuth angle spacing.

Panning factors may be determined dynamically as illustrated in the flow chart of FIG. 17. FIG. 17 exemplarily illustrates a panning coefficient calculation for virtual sources that are distributed on the horizontal plane with variable azimuth angle spacing. While the compensation of momentary head rotations may be beneficial for the stability of virtual source locations and, therefore, improves the listening experience, in most cases it is, however, not desirable to permanently shift the frontal or rear sources towards the side of the user's head. Permanent head rotations, therefore, should not be compensated permanently or permanent compensation should at least be optional such that the user may decide whether compensation should be activated or not. To avoid permanent compensation, the head azimuth angle may be treated with a high-pass function that allows momentary deflections from the starting position or rest position (e.g. 0° azimuth), but dampens permanent deflections. The high-pass frequency will usually be in the sub-hertz region. Due to the reasons already described above, the momentary head rotation angle deflection $\Delta\varphi$ from the rest position (0° azimuth), which for the given example is positive for clockwise head rotations and negative for counter clockwise rotations, is high-pass filtered (HP) in a first step, as illustrated in the flow chart of FIG. 17. In a next step (LIM), the absolute value of the deflection angle is limited to a value smaller or equal to the smallest azimuth angle difference between all virtual source positions. This may be required because the maximum possible image shift is defined by the smallest azimuth angle between adjacent virtual sources if panning is only carried out between adjacent virtual sources as illustrated in FIG. 16.

After the limitation (LIM) step, the momentary deflection angle $\Delta\varphi_{lim}$ is determined. If the momentary deflection angle $\Delta\varphi_{lim}$ is negative, it is converted to its absolute value (ABS). In the current example, the momentary deflection angle $\Delta\varphi_{lim}$ is negative for counter clockwise head rotations. Afterwards the momentary deflection angle $\Delta\varphi_{lim}$ is normalized (NORM) to become $\pi/2$ if it equals the azimuth angle difference between the reference virtual source position associated with the respective channel and the next virtual source position in the clockwise direction.

Normalization (NORM) is carried out individually for each of the channels to allow for individual azimuth angle differences between associated virtual sources. From the resulting normalized momentary deflection angles (e.g. $\Delta\varphi_{norm_FL}$), the panning factors for the channel associated with the reference or rest source position (e.g. $S_{REF_FL}$) and for the next channel associated with the next virtual source position in clockwise direction (e.g. $S_{CW_FL}$) are calculated as cosine and sine (or squared cosine and sine) of the normalized deflection angles. For clockwise head rotations and the resulting positive deflection angle, the normalization is carried out with respect to the azimuth angle difference between the reference virtual source position associated with the respective channel and the next virtual source position in counter clockwise direction. Panning factors for the channel associated with the reference or rest source position (e.g. $S_{REF_FL}$) and the next channel associated with the next virtual source position in counter clockwise direction (e.g. $S_{CCW_FL}$) are calculated as cosine and sine (or squared cosine and sine) of the normalized deflection angles. The resulting momentary panning factors are then applied in a signal flow arrangement as illustrated in FIG. 16.

Head tracking in the horizontal plane by means of panning between virtual sources generally delivers the best results if the virtual sources are spread on a path around the head that resembles a circle in the horizontal plane. The smaller the difference in azimuth angle between virtual sources, the closer the path on which a sound image travels around the head due to panning across virtual sources assembled in a circle. Therefore, performance may be improved if the azimuth range intended for image shifts contains multiple virtual sources that may be spread evenly across the range. For this purpose, additional virtual sources may be generated outside the reference or rest source positions, as has been described above. As the distance control (DC) block remains unchanged during image shifting by means of panning between virtual sources, the generated reflections do not match the intermediate source or image positions perfectly. However, as the proposed directional resolution for reflections was quite low from the start with only four main directions, mismatch between virtual source position and directions of reflections is insignificant.

A second processing method is configured to improve virtual source localization, especially on the sides of the user, as compared to the first processing method, in such cases in which only natural directional pinna cues associated with front and back are available (no natural directional pinna cues associated with the sides are available). The tonal coloration depends on implementation details mainly of HRTF-based processing. As the second processing method supports high performance head tracking for full 360° head rotations around the vertical axis, it is ideally suited for 2D surround applications.

Figure 18:
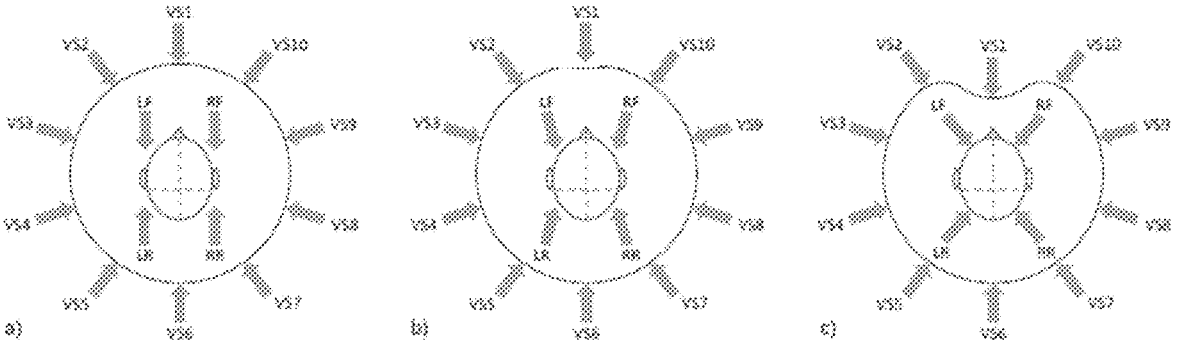
FIG. 18 schematically illustrates examples for directions associated with respective natural pinna cues for the left and right ear as well as corresponding paths of possible virtual source positions around the head.

FIG. 18 illustrates several exemplary directions that are associated with respective natural pinna cues for the left (LF, LR) and right ear (RF, RR). Each of the examples a), b) and c) of FIG. 18 illustrates various azimuth angles (inside the illustrated circular shape) as well as the corresponding paths of possible virtual source positions (outside the circular shape) around the head which may be generated by means of the second processing method when combined with these pinna cues. It should be noted that despite the lack of natural pinna cues from the sides, the path of possible virtual sources around the head resembles a circle at the sides of the user. To the contrary, the frontal part of the path is deformed if the azimuth angles associated with the natural directional pinna cues of the frontal direction deviate too far from the center position (center position=azimuth 0°). In addition, ten different exemplary virtual source directions (VSx) are illustrated which are equally distributed on the horizontal plane regarding their azimuth angle, resulting in an azimuth angle delta of about 36° between adjacent sources. The advantages of this virtual source distribution are the largely matching positions with common surround sound formats and the relatively small delta angle between sources that allows for seamless panning between virtual sources despite only three additional source positions as compared to 7.1 surround.

However, it should be noted that source direction paths around the head as shown in FIG. 18 merely represent a tendency and should not be understood as fixed positions. For example, variations over individual users are generally inevitable.

For full 360° source positioning around the user's head with stable and precise source locations, loudspeaker arrangements that provide a minimum of two natural directional pinna cues are provided per ear. Strong natural directional cues usually cannot be fully compensated by opposing directional filtering based on generalized HRTFs. Instead, natural directional cues from opposing directions may be superimposed to obtain directional cues between the opposing directions. As has been described above, natural pinna cues associated with directions in the front are usually required to improve precision and stability of virtual sources in the frontal hemisphere, especially directly in front of the user. Therefore, the natural pinna cues for each ear should advantageously be associated with approximately opposing directions and, if the desired path of possible source positions (e.g. as shown in FIG. 18 *a*)) includes azimuth and elevation angles close to the intersection axis of horizontal and median plane, one of the natural directional cues per ear may be associated with a frontal direction, preferably a direction close to the point on the path that is closest to the intersection axis of the horizontal and the median plane. In addition, the elevation angles of the directions associated with the natural pinna cues for the left and right ear may be largely identical for natural pinna cues within the same hemisphere and natural pinna cues may be symmetrically spaced with regard to their azimuth angles with respect to the median plane. For a typical stereo or surround setup of virtual sources, a pair of frontal cues (LF, RF) as illustrated in FIGS. 18 *a*) and *b*) may be preferable. As illustrated in FIG. 18 *c*), natural frontal directional pinna cues with azimuth angles deviating too much from the zero azimuth position, tend to result in deformed paths of possible virtual sound source positions around the user's head if combined with the second processing method.

Figure 19:
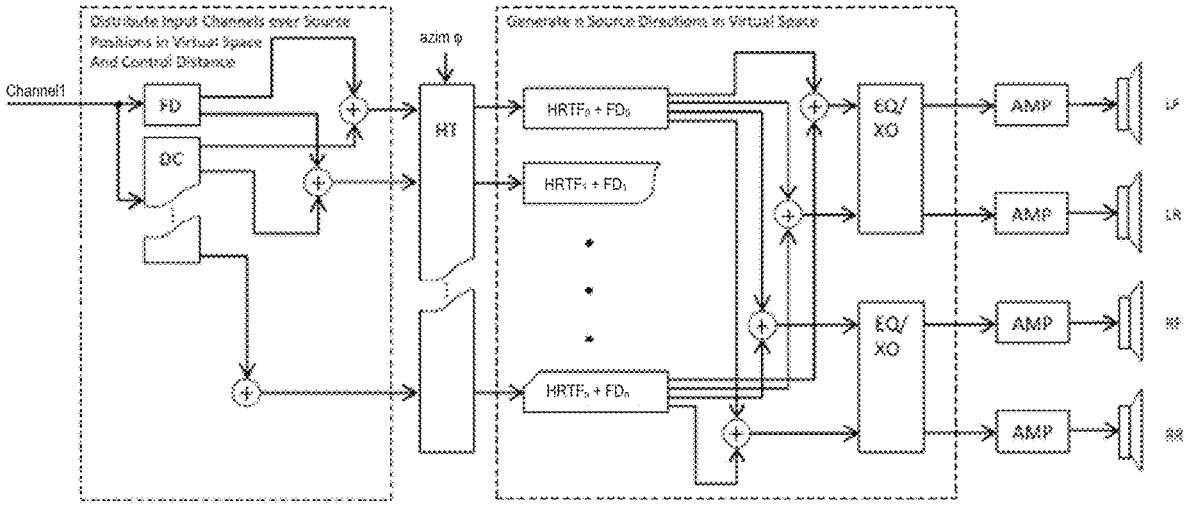
FIG. 19 schematically illustrates an example of a signal flow arrangement according to one example of the second processing method.

FIG. 19 schematically illustrates a possible signal flow arrangement according to one example of the second processing method. On the right side of a head tracking (HT) block, an arbitrary number of virtual source directions is generated essentially by means of HRTF-based processing and controlling of natural pinna cues by distributing signals over the loudspeaker arrangements that generate the natural pinna cues associated with various directions (LF, LR, RF, RR). For example, a set of ten virtual source directions in the horizontal plane may be generated with an equal azimuth difference between adjacent source directions, as illustrated in FIG. 18, provided that source directions associated with the available natural pinna cues of the loudspeaker arrangements generally support this. On the left side of the head tracking HT block, an arbitrary number of input channels may be distributed between the virtual source directions that are defined by the processing on the right side of the head tracking HT block and the natural directional pinna cues provided by the loudspeaker arrangements. In FIG. 19 this is exemplarily illustrated for a first input channel Channel1. Additional input signals (channels) are simply added in the same way. In the following, no distinction is made between the terms "signals" and "channels". The distance of the sources in their respective direction may be controlled by means of the distance control block (DC), which is also exemplarily illustrated for the first channel Channel1 in FIG. 19. Distance control for additional input channels may be carried out with additional distance control DC blocks that are connected in the same way as is illustrated for the first channel Channel1. The head tracking (HT) block rotates the user in virtual acoustic space, as determined by the physical head rotation angle of the user. If a loudspeaker arrangement that provides natural directional pinna cues does not move with the user's head, the head tracking block may not be required and may be replaced by straight direct connections between associated input and output channels.

The first input channel Channel1 is distributed between two adjacent inputs of the head tracking (HT) block associated with adjacent virtual source directions by means of the fade (FD) block to determine the location of the virtual source associated with the first input channel Channel1. All inputs of the head tracking HT block relate to virtual source directions in virtual space for which the azimuth and elevation angles with respect to the user, who is in the reference position (the user facing the origin of the azimuth and elevation angle as illustrated in FIG. 18), are determined by further processing which follows the head tracking HT block in combination with the natural directional pinna cues that are provided by the loudspeaker arrangements. The distance control (DC) block generates reflection signals for some or all of the directions provided by the processing on the right side of the head tracking HT block to control the distance of the source and to generate and possibly increase envelopment by appropriate reverberation. The reflection signals are fed to the respective inputs of the head tracking HT block associated with directions in virtual space. During the head tracking, the positions of the virtual sources are shifted with regard to the user's head, which fixes their position in virtual space. By distributing the input channels over two adjacent inputs of the head tracking HT block, the virtual source position associated with the input channel may be determined between the virtual source positions. If an input channel is only fed to one input of the head tracking HT block, the direction of the associated source in virtual space matches the corresponding direction that is provided by the processing on the right side of the head tracking HT block. Functions and implementation options of the individual processing blocks will be described in the following.

The distance control (DC) block basically functions as has been described before with respect to the first processing method. The distance control DC block generates delayed and filtered versions of the input signal for some or all directions in virtual space that are provided by means of the subsequent processing and loudspeaker arrangements, and supplies them to the corresponding inputs of the head tracking HT block. This is illustrated in the signal flow of FIG. 20, which comprises individual transfer functions $H_{R_VSn}$ between the input Source x and each of the outputs VS1, VS2, . . . , VSn. Implementation options are, for example, FIR filters or delay lines with multiple taps and other suitable filters or the combination of both. Methods for the determination of the reflection patterns are known and will not be described in further detail.

The reasons for and meaning of head tracking within the context of the current disclosure have been described above. As is illustrated in FIG. 19, the head tracking block (HT) has an equal number of inputs and outputs 1-n which is equal to the number of available virtual source directions that are connected one-to-one according to their number if the user's head is in the reference position. When the user's head is rotated out of the reference position, the head tracking block determines the distribution between input and output channels based on the momentary azimuth angle φ. An example for the calculation of the output signals OUTy for any output index y is given with equations 6.1 below. These calculations may be carried out cyclically with an appropriate interval to update the position of the virtual sources with respect to the user's head.

x: Index of input channel of head tracking block; x is integer>0 y: Index of output channel of head tracking block; y is integer>0

φ: Momentary required azimuth angle shift of all sources in counterclockwise direction with respect to reference position; $0° <= \varphi < 360°$ $\varphi_{rad} = \varphi * \pi/180$ nS: Number of equally spaced virtual sources on a circle around the center of the user's head CS: Channel spacing; CS=360°/nS q: Integer Quotient of φ DIV CS operation (DIV=division with quotient rounded towards 0)

r: Remainder of φ MOD CS operation (MOD=modulo operation)

$r_{norm}$ remainder r normalized to π/2; $r_{norm} = \varphi_{rad} * 90/CS$ $S_FAI_y$: Shift factor of first associated input for output y; $S_FAI_y = \sin(r_{norm})\hat{}2$ $S_NAI_y$: Shift factor of next associated input for output y; $S_NAI_y = \cos(r_{norm})\hat{}2$ $FAI_y$: First associated input for output y; $FAI_y = y+q$ for $y+q <= nS$ and $FAI_y = y+q-nS$ otherwise $NAI_y$: Next associated input for output y; $NAI_y = FAI_y + 1$ for $FAI_y < nS$ and $FAI_y = 1$ otherwise $OUT_y$: Output y of head tracking block; $OUT_Y = FAI_Y * S_FAI_y + NAI_y * S_NAI_y$ (Equations 6.1)

Basically, the calculations of Equation 6.1 are intended to identify two inputs that may feed each output y at any given time ($FAI_y$ and $NAI_y$). Therefore, the inputs and outputs 1–n may be shifted circularly to each other, based on the required azimuth angle shift and the angular spacing between virtual sources (CS). In addition, the calculations determine the factors ($S_FAI_y$ and $S_NAI_y$) that are applied to these input signals before they are summed to the corresponding output. These factors determine the angular position of the input channels between two adjacent output channels. As any input is distributed to two outputs as a result of the above calculations that are carried out for all outputs, it may be effectively panned between these outputs by means of simple sine/cosine panning, as illustrated by means of equation 6.1.

The $HRTF_x$+$FD_x$ processing blocks, as illustrated in FIG. 19, control the directions of the respective virtual channels by means of HRTF-based processing and signal distribution between loudspeaker arrangements delivering natural directional pinna cues that are associated with different directions. Two fading functions, natural directional cue fading NDCF and artificial directional cue fading ADCF, that may be combined with each other or applied independently, may play a major role in controlling the virtual source directions. Natural directional cue fading NDCF refers to the distribution of the signal of a single virtual channel over loudspeaker arrangements that provide largely opposing or at least different natural directional pinna cues per ear, in order to shift the direction of the resulting natural pinna cues between those potentially opposing directions or at least weaken or neutralize the directional pinna cues by the superposition of directional cues from largely opposing directions. This is, however, only possible if the respective loudspeaker arrangements are available. Therefore, it cannot be done if only a single natural directional cue is available from the loudspeaker arrangement for each ear. In this case, only artificial directional cue fading ADCF may be possible and the stable virtual source positions are usually limited to the hemisphere around the direction of the natural pinna cues. Artificial directional cue fading ADCF means the controlled admixing of artificial directional pinna cues to an extent that is controlled by the deviation of the direction of the desired virtual source position from the associated directions of the available natural pinna cues provided by the respective loudspeaker arrangements. Artificial directional cue fading ADCF usually delivers artificial directional pinna cues by means of signal processing for such source positions for which no clear or even adverse natural directional pinna cues are available from the loudspeaker arrangements. Artificial directional cue fading ADCF generally requires HRTF sets that contain pinna resonances as well as HRTF sets that are essentially free of influences of the pinna but are otherwise similar to the HRTF sets with pinna resonances. Artificial directional cue fading ADCF is optional if natural directional cue fading NDCF is applied and may further improve the stability and accuracy of virtual source positions. If artificial directional cue fading ADCF is not applied, the signal flow of FIG. 21 may be modified to only contain a single HRTF-based transfer function per side, either with or without pinna cues, and the artificial directional cue fading ADCF blocks are bypassed.

Figure 21:
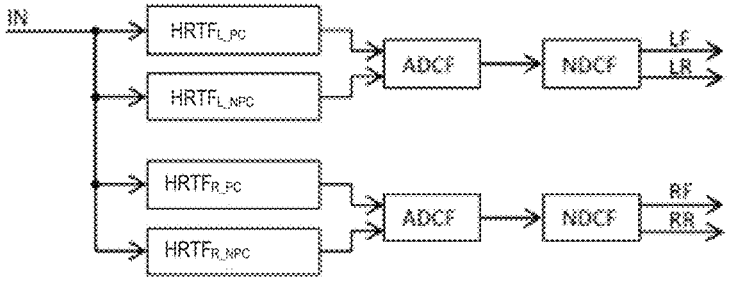
FIG. 21 schematically illustrates an example of a signal flow for a $HRTF_x$+$FD_x$ processing block of FIG. 19.

FIG. 21 schematically illustrates the concept of artificial directional cue fading ADCF and natural directional cue fading NDCF by illustrating a possible signal flow for the $HRTF_x$+$FD_x$ processing blocks as illustrated in FIG. 19. For artificial directional cue fading ADCF, a set of HRTF-based transfer functions is provided for the left ear ($HRTF_{L_PC}$, $HRTF_{L_NPC}$) and the right ear ($HRTF_{R_PC}$, $HRTF_{R_NPC}$). The subscript PC in this context implies that pinna cues are contained and the subscript NPC implies that no pinna cues are contained in the respective transfer function HRTF. The artificial directional cue fading ADCF blocks simply add the input signals after applying weighting factors that control the mixing of the signals that are processed by the HRTF with and without pinna cues. The weighting factors $S_{NPC}$ for the signal processed by the HRTF without pinna cues and the weighting factors $S_{PC}$ for the signals processed by the HRTF with artificial pinna cues may, for example, be calculated for different angles φ (see FIG. 22) between the directions supported by natural (N) and artificial (A) pinna cues. This is exemplarily illustrated by means of equation 6.2 in combination with FIG. 22. Note that φ in FIG. 22 refers to the angle for which ADCF factors are calculated while Δφ is the usually fix angle between directions supported by natural pinna cues (N) and a principal artificial pinna cue direction (A) for which pinna cues are admixed to the largest extent.

Figure 22:
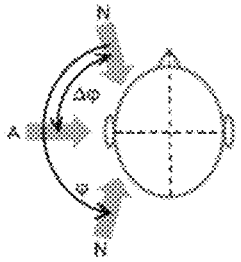
FIG. 22 schematically illustrates an example for fading between natural and artificial directional pinna cues.

Weighting factors for the fading example illustrated in FIG. 22 may be calculated as follows:

$S_{NPC}$: Factor for *HRTF* path without pinna cues (Equations 6.2)

$S_{PC}$: Factor for *HRTF* path with pinna cues $$S_{NPC} = \cos(\varphi * 90/\Delta\varphi)\text{^}2 \text{ for } \varphi <= \Delta\varphi$$

$$S_{NPC} = -\cos(\varphi * 90/\Delta\varphi)\text{^}2 \text{ for } \varphi > \Delta\varphi$$

$$S_{PC} = \sin(\varphi * 90/\Delta\varphi)\text{^}2$$

The natural directional cue fading blocks NDCF supply a part of the input signal to the output that is associated with a first direction of natural pinna cues and other parts of the input to the second output that is associated with a second direction of natural pinna cues generated for one respective ear. Weighting factors for controlling signal distribution over the different outputs and, therefore, over the associated directions of natural pinna cues may be obtained in almost the same way as illustrated by means of FIG. 22 and equations 6.2. As distribution is done between the two natural pinna cue directions (N), Δφ is the angle between these directions.

Figure 23:
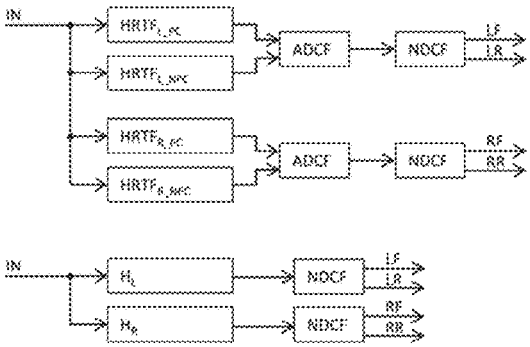
FIG. 23 schematically illustrates a further example of a signal flow for a $HRTF_x$+$FD_x$ processing block of FIG. 19.

The weighting factors for artificial directional cue fading ADCF are determined during the setup of the directional filtering for generation of virtual channels and are not changed during operation. Therefore, the signal flow of FIG. 21 may be replaced by the signal flow of FIG. 23. As a result the processing requirements per virtual source direction are equal to conventional binaural synthesis with individual transfer functions for both ears. FIG. 23 schematically illustrates an alternative signal flow example for the $HRTF_x$+$FD_x$ processing blocks of FIG. 19.

The basis for HRTF-based processing is the commonly known binaural synthesis which applies individual transfer functions to the left and right ear for any virtual source direction. HRTFs, as applied in FIG. 21, are generally chosen based on the same criteria as is the case for standard binaural synthesis. This means that the HRTF set that is applied to generate a certain virtual source direction may be measured or simulated with a sound source from the same direction. HRTFs may be processed or generalized to various extents. Further options for HRTF generation will be described in the following.

It is generally possible to apply HRTF sets that have been obtained from a single individual. If pinna resonances are contained within the HRTF sets, they will usually match the naturally induced pinna cues very well for that single individual, although superposition of natural and processing-induced frequency response alterations may lead to tonal coloration. Other individuals may experience false source locations and strong tonal alterations of the sound. If artificial directional cue fading ADCF is to be implemented, the HRTF set of any individual may be recorded, once with the typical so-called "blocked ear canal method" and a second time with closed or filled cavities of the pinna. For the second measurement the microphone may be positioned within the material that is used to fill the concha, close to the position of the ear canal entry. A HRTF set that has been obtained from an individual with filled pinna cavities may be combined with natural directional cue fading NDCF and may deliver much better results for other individuals with respect to tonal coloration, than the individual HRTF set that contains pinna resonances. The localization may also work well for other individuals because the removal of pinna resonances is a form of generalization. Another option to remove the influence of the pinna resulting from an individual measurement is to apply coarse nonlinear smoothing to the amplitude response, which can be described as an averaging over frequency-dependent window width. In this way, any sharp peaks and dips may be suppressed in the amplitude response that are generated by pinna resonances. The resulting transfer function may, for example, be applied as a FIR filter or approximated by IIR filters. The phase response of the HRTF may be approximated by allpass filters or substituted by a fixed delay.

Another way for generating HRTF sets that is suitable for a wide range of individuals is amplitude averaging between HRTFs for identical source positions obtained from multiple individuals. Publicly available HRTF databases of human test subjects may provide the required HRTF sets. Due to the individual nature of pinna resonances, the averaging over HRTFs from a large number of subjects generally suppresses the influence of the pinnae at least partly within the averaged amplitude response. The averaged amplitude response may additionally be smoothed and applied as a FIR filter, or may be approximated by IIR filters. Smoothed and unsmoothed versions of the averaged amplitude response may be utilized to implement artificial directional cue fading ADCF, because the unsmoothed version may still contain some generalized influence of the pinna. Further, the additional phase shift of the contralateral path as compared to the ipsilateral path may be averaged and approximated by allpass filters or a fixed delay.

Other generalization methods that are based on multiple sets of human HRTFs are known in the art. According to one generalization method, an output signal for the left and right ear may be generated for any virtual source direction (L, R, LS, RS etc.). The output signals may be summed to form a left (L) and right (R) output signal. Known direct and indirect HRTFs may be transferred to sum and cross transfer functions, and then eventually the sum and cross functions may be parameterized. Such a method may include steps for further simplifying the sum and cross transfer functions as to become a set of filter parameters. Furthermore, such a method for deriving the sum and cross transfer functions from known direct and indirect HRTFs may include additional steps or modules that are commonly performed during signal processing such as moving data within memory and generating timing signals.

In such a method, first the direct and indirect HRTFs may be normalized. Normalization can occur by subtracting a measured frontal HRTF, which is the HRTF at 0 degrees, from the indirect and direct HRTF. This form of normalization is commonly known as "free-field normalization," because it typically eliminates the frequency responses of test equipment and other equipment used for measurements. This form of normalization also ensures that timbres of respective frontal sources are not altered. Next, a smoothing function may be performed on the normalized direct and indirect HRTFs. Additionally, in a next step, the normalized HRTFs may be limited to a particular frequency band. This limiting of the HRTFs to a particular frequency band can occur before or after the smoothing function. In a next step, the transformation may be performed from the direct and indirect HRTFs to the sum and cross transfer functions. Specifically, the arithmetic average of the direct HRTF and the indirect HRTF may be computed that results in the sum transfer function. Also, the indirect HRTF may be divided by the sum function that results in the cross transfer function. The relationship between these transfer functions is described by the following equations; where HD=the direct HRTF, HI=the indirect HRTF, HS=the sum transfer function, and HC=the cross transfer function.

$$HS=(HD+HI)/2$$

$$HC=HI/HS \text{ or } HC=HI/HS-1$$

$$HD=HS(2-HC)$$

The sum function may be relatively flat over a large frequency band in the case where the source angle is 45 degrees. Next, a low order approximation may be performed on the sum and cross transfer functions. To perform the low order approximation, a recursive linear filter may be used, such as a combination of cascading biquad filters. With respect to the sum transfer function, peak and shelving filters are not required considering the sum function is relatively flat over a large frequency band where the sound source angle is 45 degrees with respect to a listener. Also, for this reason a sum filter is not necessary when converting an audio signal outputted from a source positioned 45 degrees from the listener. Sum filters may be absent from the transformation of the audio signals coming from sources each having a 45 degree source angle. Alternatively, sum filters equaling a constant 1 value could be added. Finally, after one or more iterations of the previous steps, one or more parameters may be determined across one or more of the resulting sum transfer functions and cross transfer functions that are common to the one or more of the resulting sum transfer functions and cross transfer functions. For example, in performing the method over a number of HRTF pairs, it was found that Q factor values of 0.6, 1, and 1.5 where common amongst a resulting notch filter in the 45 degrees cross function approximation. A parametric binaural model may be built based on these parameters and the model may be utilized to generate direct and indirect head related transfer functions that lack influences of the pinnae.

For combining such generalization methods with the second processing method proposed herein above, the output for the left and right ear that is produced for any virtual source direction may be fed into NDCF blocks to implement appropriate natural directional cue fading for the respective azimuth angle of the virtual source direction. It should be noted that some HRTF generalization methods may be applied to generate virtual sources in any desired direction. For example, the multitude of equally spaced virtual sources on the horizontal plane as illustrated in FIG. 18 (VSx) may be supported by such a method.

Dummies or manikins, also known as head and torso simulator (HATS), may also be used to measure suitable HRTF sets. In this case, artificial directional cue fading ADCF may easily be supported if the HRTF sets are measured once with and once without a pinna mounted on the dummy head. HRTFs may be directly applied by means of FIR filters or approximated by IIR filters. The phase may be approximated by allpass filters or a fixed delay. As HATS are usually constructed with average proportions of certain human populations, HRTF sets obtained from measurements on HATS fall under the category of generalized HRTFs.

Instead of HRTF measurements, HRTF simulations of head models may be utilized. Simple models without pinna are suitable if artificial directional cue fading ADCF is not implemented.

Another processing option for human or dummy HRTFs has been described above with respect to equation 5.1 and FIG. 7, which focuses on the difference in amplitude and phase between transfer functions from the source to the contralateral and ipsilateral ear. The resulting transfer function may be applied in a way as is illustrated in FIG. 8, optionally in combination with the equalization that is also illustrated in FIG. 8. In this way colorations may be reduced that are caused by the comb filter effect induced by crossfeed for correlated direct signals on the left and the right ear. The left (L) and right (R) inputs of FIG. 8 represent two virtual source directions for each of which a signal for both ears is generated. For combination with the second processing method as proposed above, the output for the left and right ear that is produced for any virtual source direction may be fed into the NDCF blocks of FIG. 23 to implement appropriate natural directional cue fading for the respective azimuth angle of the virtual source direction. The phase difference between the contralateral and ipsilateral HRTF may in this case be approximated by allpass filters or substituted by a fixed delay in the same order of magnitude as the delay caused by head shadowing.

Whenever possible, IIR or FIR filters may be applied to implement signal processing according to the HRTF-based transfer functions described above. However, analog filters are also a suitable option in many cases, especially if highly generalized or simplified transfer functions are used.

The EQ/XO blocks that are illustrated in FIG. 19 implement the same functions and serve the same purpose as described with respect to the first processing method and FIG. 13. As has been described above, equalizing generally relates to the control of tonality and loudspeaker frequency range as well as to the alignment of amplitude, sound arrival time and, possibly, phase response between loudspeakers or loudspeaker arrangements that are supposed to play in parallel over parts of the frequency range. The crossover function generally relates to the signal distribution between loudspeakers or loudspeaker arrangements that are utilized for the generation of natural directional pinna cues either for different directions or for a single direction. The latter may be the case if a loudspeaker arrangement consists of multiple different loudspeakers that are intended to produce natural directional pinna cues associated with a single direction.

The EQ/XO blocks provide the necessary basis for the fading of natural directional cues (NDCF) by means of largely equal amplitude responses of loudspeaker arrangements that are utilized to generate natural directional pinna cues from different directions. Furthermore, they implement bass management in form of low frequency distribution tailored to the abilities of the involved loudspeakers.

In the following, a third processing method according to the present disclosure will be described. The third processing method supports virtual source directions all around the user. The third processing method further supports 3D head tracking and, possibly, additional sound field manipulations. This may be achieved by means of combining higher order ambisonics with HRTF-based processing and natural directional cue fading for two or three dimensions (NDCF, NDCF3D) and artificial directional cue fading for two or three dimensions (ADCF, ADCF3D) for the generation of virtual sources. Therefore, the third processing method may be ideally combined with virtual reality and augmented reality applications.

In order to position virtual sources in three dimensions around the user, either natural or artificial directional pinna cues should be available at least on or close to the median plane, because this region generally lacks interaural cues. On the sides of the user's head, natural or artificial directional pinna cues may be applied for virtual source positioning. Alternatively, natural directional cue fading in one or two dimensions, supporting virtual sources in two or three dimensions, respectively, may be utilized without artificial pinna cues from the sides, relying purely on interaural cues for virtual source positioning. This avoids tonal colorations caused by foreign pinna resonances.

Figure 24:
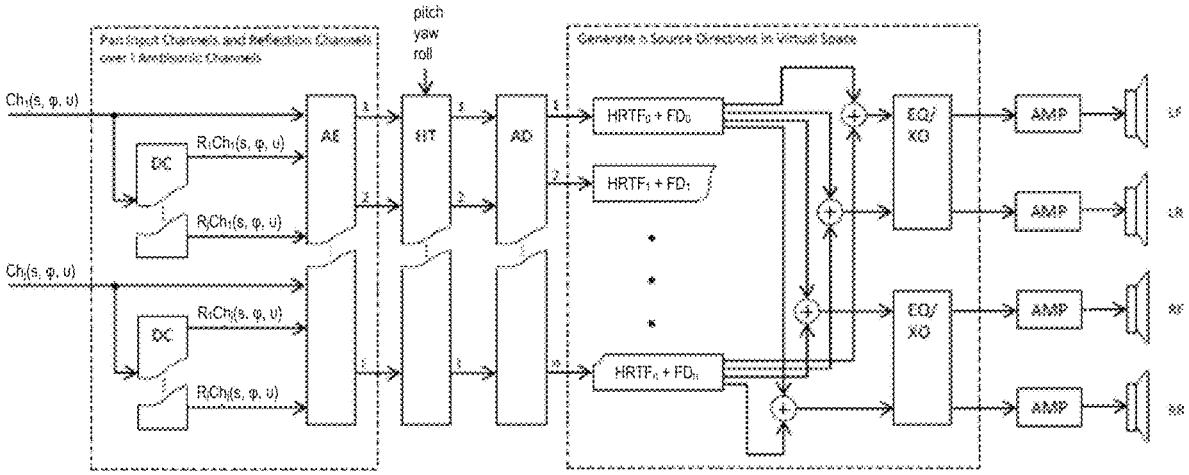
FIG. 24 schematically illustrates a signal processing flow arrangement according to one example of a third processing method.

An example of a signal flow arrangement for the third processing method is illustrated in FIG. 24. The signal flow arrangement of FIG. 24 is related to a layout of natural directional cues that are approximately located within a single plane. This is exemplarily illustrated in FIGS. 18 *a*) and *b*) for the horizontal plane to provide natural directional cues for front and rear directions of each ear (LF, LR, RF, RR). An arbitrary number of input channels ($Ch_1$ to $Ch_j$), each input channel $Ch_1$ to $Ch_j$ comprising a mono signal (s) and information about the target position of the associated virtual source (azimuth angle $\varphi$ and elevation angle $\nu$), is fed into higher order ambisonics encoders (AE) and into respective distance control blocks (DC). The distance control blocks DC are configured to output an arbitrary number of reflection channels ($R_1Ch_1$ to $R_iCh_j$). The reflection channels ($R_1Ch_1$ to $R_iCh_j$) comprise target positions angles ($\varphi$, $\nu$) and are fed into the ambisonics encoder AE. The ambisonics encoder AE is configured to pan all input signals to a number of 1 ambisonics channels with the channel number 1 depending on the ambisonics order. Within the head tracking block (HT) head movements of the user may be compensated in the ambisonics domain for loudspeaker arrangements that are configured to move with the head by opposing head rotations around the x- (roll), y- (pitch) and z-axis (yaw). Afterwards, the ambisonics decoder (AD) decodes the ambisonics signals and outputs the decoded signals to a virtual source arrangement provided by the following signal flow arrangement with $n \geq 1$ virtual source channels. By means of HRTF-based filtering and natural as well as artificial pinna cue fading, the $HRTF_x+FD_x$ blocks significantly control the direction of n virtual source positions in 3D space when combined with downstream signal processing and natural directional pinna cues from physical sound sources. The $HRTF_x+FD_x$ blocks are configured to provide signals for both natural pinna cue directions for the left and the right ear. The outputs of the $HRTF_x+FD_x$ blocks are then summed up prior to being supplied to the respective EQ/XO blocks. The EQ/XO blocks are configured to perform equalizing, time and amplitude level alignment and bass management for the physical sound sources. Further details concerning the individual processing blocks will be described in the following.

FIG. 24 schematically illustrates a signal processing flow for four loudspeakers or loudspeaker arrangements that are configured to generate natural directional pinna cues for two source directions per ear that are approximately symmetrically distributed on the left and the right side of the median plane, the signal processing flow supporting an arbitrary number of input channels and virtual source positions.

Figure 20:
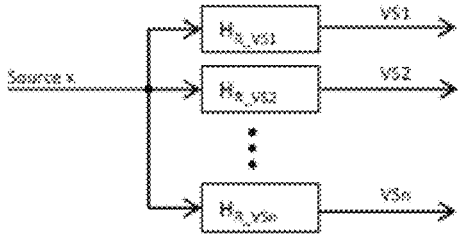
FIG. 20 schematically illustrates an example of a signal flow for a distance control block of FIG. 19.

The distance control (DC) block essentially functions in the way as has been described before with reference to the first and the second processing method and FIG. 20. The distance control DC block generates delayed and filtered versions of the input signal for an arbitrary number of directions in virtual space. This is illustrated by means of the signal flow of FIG. 20, which comprises individual transfer functions from the input to all of the outputs. Examples for implementation options are FIR filters or delay lines with multiple taps and filters or the combination of both. Methods for determining the reflection patterns are known in the art and will not be described in further detail.

Within the ambisonics encoder (AE), all input channels (mono source channels $Ch_1$ to $Ch_j$ as well as reflection signal channels $R_1Ch_1$ to $R_iCh_j$) may, for example, be panned into the ambisonics channels by means of gain factors that depend on the azimuth and elevation angles of the respective channels. This is known in the art and will not be described in further detail. The ambisonics decoder may also implement mixed order encoding with different ambisonics orders for horizontal and vertical parts of the sound field, for example.

Head tracking (HT) in the ambisonics domain may be performed by means of matrix multiplication. This is known in the art and will, therefore, not be described in further detail.

Decoding of the ambisonics signal may, for example, be implemented by means of multiplication with an inverse or pseudoinverse decoding matrix derived from the layout of the virtual source positions and provided by the downstream processing and the loudspeaker arrangements generating natural directional pinna cues. Suitable decoding methods are generally known in the art and will not be described in further detail.

Similar to the second processing method, the $HRTF_x$+$FD_x$ processing blocks, as illustrated in FIG. 24, are configured to control the directions of the respective virtual channels by means of HRTF-based processing and signal distribution between loudspeaker arrangements that are configured to deliver natural directional pinna cues associated with different directions. Natural directional cue fading NDCF and optionally artificial directional cue fading ADCF may be applied in control of virtual source directions. Artificial directional cues may be added in any case, but are generally required only if available natural directional cues do not cover at least three directions on the median plane (e.g. front, rear low, rear high). In combination with the second processing method and FIG. 62, cue fading for source positioning in two dimensions has been shown which requires fading between cues in a single half plane per side. For a 3D sound field all around the user, cue fading within left and respectively right hemispheres may be required, also referred to as 3D cue fading (NDCF3D and ADCF3D).

NDCF3D in this context refers to the distribution of the signal of a single virtual channel over at least three loudspeaker arrangements, providing natural directional pinna cues for multiple different, possibly opposing directions per ear in order to shift the direction of the resulting natural pinna cues between those directions or at least weaken or neutralize the directional pinna cues by the superposition of directional cues from largely opposing directions. This may only be possible if the respective loudspeaker arrangements are available. Therefore, it may not be possible if only natural directional cues associated with two directions are available per ear from the available loudspeaker arrangement. In this case, NDCF may only be possible for two dimensions and ADCF3D is required for an extension of the sound field to 3D.

ADCF as well as ADCF3D refer to the controlled admixing of artificial directional pinna cues to an extent that is controlled by the deviation of the direction of the desired virtual source position from the associated directions of the available natural pinna cues that are provided by the respective loudspeaker arrangements. ADCF and ADCF3D deliver artificial directional pinna cues by means of signal processing for source positions for which no clear or even adverse natural directional pinna cues are available from the loudspeaker arrangements. ADCF and ADCF3D generally require HRTF sets that contain pinna resonances as well as HRTF sets that are essentially free of influences of the pinna. ADCF or ADCF3D are optional if NDCF3D is applied and may further improve stability and accuracy of virtual source positions. If neither ADCF nor ADCF3D are applied, the signal flow of FIG. 21 may be modified to only contain a single HRTF-based transfer function per side, either with or without pinna cues, and the ADCF blocks may be bypassed. For ADCF, as has been exemplarily described with respect to the second processing method and FIG. 22 as well as equation 6.2, only a single principal artificial pinna cue direction may be available. For this direction (A in FIG. 22) artificial pinna cues are mixed in to the full extent, while artificial pinna cues from the respective directions are only mixed in to a reduced extent, away from position A. In addition, the available directions that are supported by natural pinna cues as well as possible directions for virtual sources approximately lie within the same plane as the principal artificial pinna cue direction. In contrast, directions associated with natural pinna cues as well as possible virtual source directions may be distributed over a sphere around the user for ADCF3D, which may additionally be based on more than one principal artificial pinna cue direction.

The concepts of ADCF and NDCF have already been described with reference to FIG. 21, which illustrates a signal flow that also applies for ADCF3D (but not NDCF3D), as may be implemented in the HRTFx+FDx processing blocks as illustrated in FIG. 24. For ADCF as well as ADCF3D, a set of HRTF-based transfer functions may be provided for the left (HRTFL_PC, HRTFL_NPC) and right ear (HRTFR_PC, HRTFR_NPC). The subscript PC is used if pinna cues are contained in and the subscript NPC is used if no pinna cues are contained in the respective HRTF. The ADCF blocks simply add the input signals after applying weighting factors that control the mix of the signals processed by the HRTF with and without pinna cues and are, therefore, similar for ADCF and ADCF3D. For ADCF3D the weighting factors $S_{NPC}$ for the signal processed by the HRTF without pinna cues and weighting factors $S_{PC}$ for the signal with artificial pinna cues may be calculated in a way that differs from the way proposed above for ADCF.

Figure 25:
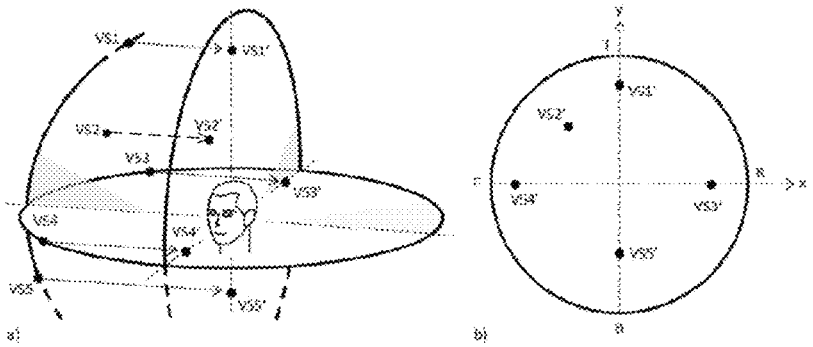
FIG. 25 schematically illustrates the projection of virtual source positions onto the median plane.

FIG. 25 *a*) illustrates virtual sources VS1 to VS5. The virtual sources VS1 to VS5 are distributed on the right half of a unit sphere around the center of the user's head. As the general concept is the same for virtual sources within the left and the right hemisphere, only the right hemisphere will be discussed in the following. Furthermore, FIG. 25 *a*) illustrates that all virtual sources are projected to the median plane as VS1' to VS5' with the direction of projection being perpendicular to the median plane.

The resulting projected source positions can be seen in FIG. 25 *b*), which illustrates a unit circle within the median plane around the center of the user's head. Also illustrated are the directions front (F), rear (R), top (T) and bottom (B) from the perspective of the user as well as a cartesian coordinate system with the origin located at the center of the user's head. The Cartesian coordinates of the projected source positions may, for example, be calculated as $x=\sin(\pi/2-\nu)*\cos\varphi$ and $y=\cos(\pi/2-\nu)$.

Figure 26:
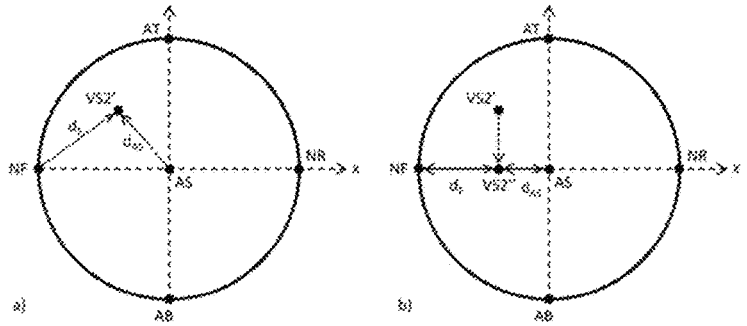
FIG. 26 schematically illustrates different methods for measuring the distances between a projected source position and the positions of the nearest natural and artificial sources.

An example of a method for determining the weighting factors $S_{NPC}$ and $S_{PC}$ is further described with respect to the projected virtual source V2' with respect to FIG. 26. In FIG. 26, the unit circle in the median plane, as illustrated in FIG. 25 *b*), is illustrated with all virtual source projections removed besides VS2'. Available directions based on natural directional pinna cues are designated with NF (natural source direction front) and NR (natural source direction rear) and corresponding natural sources in the median plane are positioned on the unit circle (indicated as black dots). These directions coincide with the natural pinna cue directions illustrated in FIG. 18 *a*), however, this position may also be assumed for loudspeaker arrangements that merely provide frontal directions as illustrated in FIG. 18 *b*). Furthermore, principal artificial pinna cue directions AS (artificial pinna cue direction side), AT (top) and AB (bottom) are illustrated, representing the directions for which artificial pinna cues are mixed in to the full extent. Further, corresponding artificial sources are positioned on the unit circle in the median plane and the origin of the circle for these directions. Due to the lack of natural directional pinna cues for top and bottom directions, these cues are replaced by artificial pinna cues induced by signal processing.

FIGS. 26 *a*) and *b*) illustrate two different possibilities for performing a distance measurement between the projected virtual source position VS2' and the nearest natural source position NF and the nearest artificial source position AS, respectively. In the option illustrated in FIG. 26 *a*), the distance $d_F$ between the nearest natural source NF and the projected virtual source VS' may directly be calculated from the cartesian coordinates of the respective source positions (origin of coordinate system at center of unit circle). A distance $d_{AS}$ between the projected virtual source VS' and the closest artificial source AS may be calculated in the same way. According to the second option that is illustrated in FIG. 26 *b*), the previously projected source position VS2' is projected onto the straight line which connects the natural source NF and the artificial source AS that were previously determined to be the closest natural and artificial source to VS2'. The direction of the projection is perpendicular to the line between the natural source NF and the artificial source AS and results in VS2". Now the distances $d_F$ between VS2" and the natural source NF as well as $d_{AS}$ between VS2" and the artificial source AS may be calculated from the cartesian coordinates of the respective source positions.

When the distances $d_F$ and $d_{AS}$ are known, the weighting factors $S_{NPC}$ and $S_{PC}$ may be calculated based on a method that is known as distance based amplitude panning (DBAP). To be able to perform this calculation method, the positions of the natural source NF and of the artificial source AS and either VS2' or VS2" are determined as has been described above. The resulting weighting factor for the position of the natural source NF is applied as $S_{NPC}$, which is the factor for the signal flow branch that contains the HRTF without pinna cues. The weighting factor for the position of the artificial source AS is applied as $S_{PC}$. As an alternative to the DBAP method, the distance between the natural source NF and the artificial source AS may be normalized to $\pi/2$ and $d_{AS}$ of FIG. 26 *b*) may be expressed in fractions of this distance in radians. $S_{NPC}$ and $S_{PC}$ may then be calculated as sine and cosine (or squared sine and cosine) of $d_{AS}$. According to an alternative calculation method, $S_{NPC}$ and $S_{PC}$ may be calculated as $S_{NPC}=d_{AS}(d_{AS}+d_F)$ and $S_{PC}=d_F/(d_{AS}+d_F)$. The described concept that utilizes the nearest natural (e.g. NF) and artificial source position (e.g. AS) in the median plane, as corresponding to available directions of natural pinna cues (e.g. F) and principal artificial pinna cue directions (e.g. S), for the determination of $S_{NPC}$ and $S_{PC}$ for any given projected virtual sound source on the median plane (e.g. VS2'), may be applied irrespective of the number of available natural and artificial source positions.

As has been stated before, NDCF3D requires at least three available natural pinna cue directions. Therefore, referring to FIG. 26, if only two natural source directions are available, only NDCF is generally possible and ADCF3D extends the 2D plane to 3D. NDCF3D will be described below after the introduction of a signal flow supporting four natural source directions per ear, as illustrated in FIG. 27.

Figure 27:
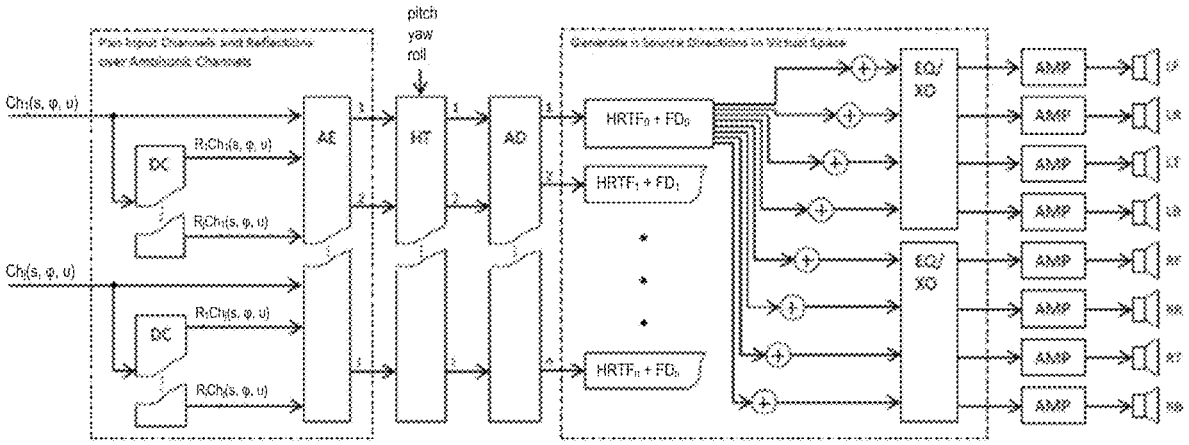
FIG. 27 schematically illustrates a further signal processing flow arrangement according to one example of the third processing method.

FIG. 27 schematically illustrates a signal processing flow arrangement for eight loudspeakers or loudspeaker arrangements that are configured to create natural directional pinna cues for four source directions per ear that are approximately symmetrically distributed on the left and the right side of the median plane. The arrangement supports an arbitrary number of input channels and virtual source positions.

Figure 28:
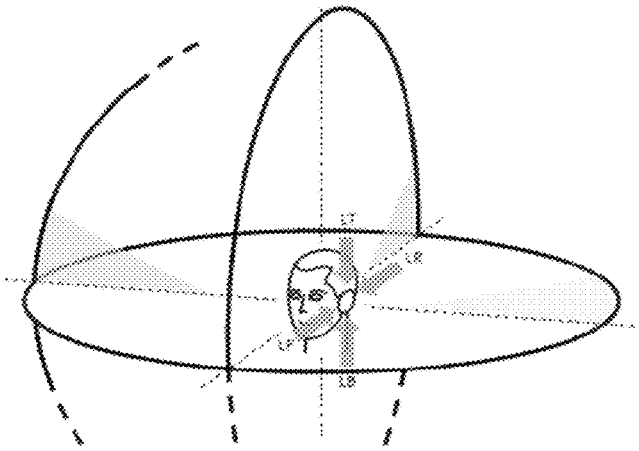
FIG. 28 schematically illustrates the distribution of source directions for the left ear that are supported by natural pinna cues.

The signal processing flow arrangement of FIG. 27 supports loudspeakers or loudspeaker arrangements that are configured to provide natural directional pinna cues for four source directions per ear. The signal processing flow arrangement differs from the signal processing flow arrangement of FIG. 24. In particular, the implementation of the $HRTF_x+FD_x$ and the EQ/XO blocks is different for the two arrangements. Referring to FIG. 27, the arrangement features an increased number of external connections as compared to the arrangement of FIG. 24. The $HRTF_x+FD_x$ blocks in the arrangement of FIG. 27 may be configured to distribute the signal of a single virtual channel over eight loudspeakers or loudspeaker arrangements that are configured to provide natural directional pinna cues for four possibly opposing directions per ear. These directions may, for example, be arranged as is illustrated in FIG. 28. For the sake of clarity, FIG. 28 solely illustrates the directions for the left ear of the user, while the corresponding directions for the right ear are not illustrated in FIG. 28.

Figure 29:
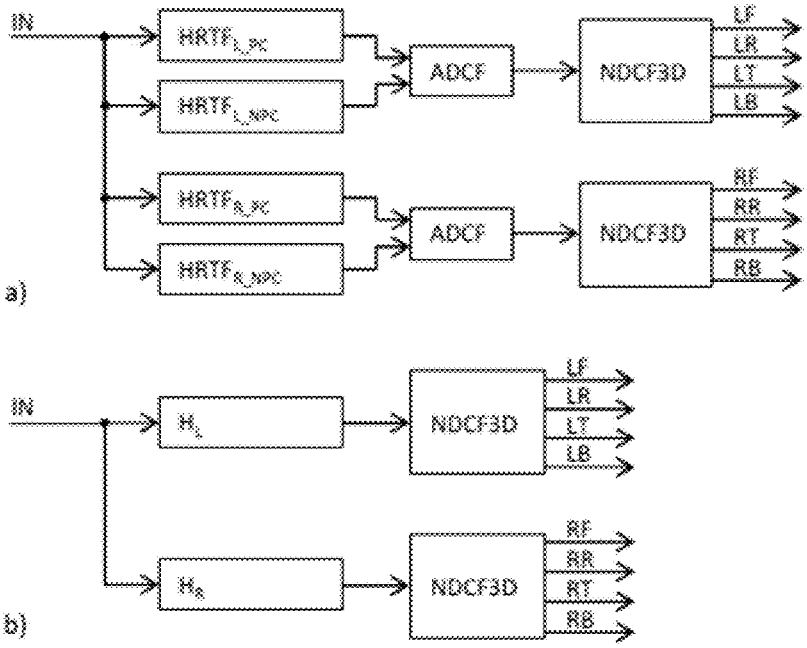
FIG. 29 schematically illustrates signal flow arrangements for the HRTFx+FDx processing blocks of the arrangement of FIG. 27.

Possible signal flows for the HRTFx+FDx blocks are illustrated in FIG. 29. The differences to previously described signal flows for the HRTFx+FDx blocks lie in the NDCF3D blocks. Referring to FIG. 29, the HRTFx+FDx blocks are configured to distribute the input signal over four output signals that are associated with four loudspeakers or loudspeaker arrangements configured to create natural pinna cues for four directions per ear. The signal distribution is implemented by means of four weighting factors (SF, SR, ST and SB) that are applied to the input signal.

Figure 30:
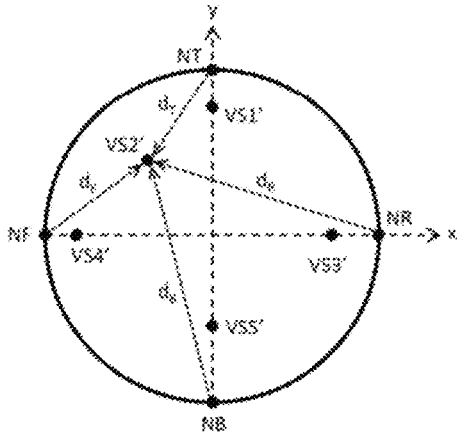
FIG. 30 schematically illustrates projected virtual source positions within a unity circle on the median plane as well as natural source positions on the unity circle.

These weighting factors (SF, SR, ST and SB) may, for example, be obtained by the distance based amplitude panning (DBAP) method as has been described before. As illustrated in FIG. 25, virtual source positions on a unit sphere around the user that correspond to desired virtual source directions may be projected to the median plane. Such projected virtual source positions are illustrated in FIG. 30. FIG. 30 schematically illustrates projected virtual source positions (VS1' to VS5') within a unit circle on the median plane. FIG. 30 further illustrates natural source positions on the unit circle (NF, NR, NT, NB) that correspond to directions that are associated with natural pinna cues generated by available loudspeakers or loudspeaker arrangements.

As an alternative to the method of weighting factor generation for ADCF3D that has been described above, weighting factors for NDCF3D for the generation of any virtual source may be determined based on the distance of the respective projected virtual source position on the median plane to all available natural source positions on the unit circle. This is exemplarily illustrated for VS2' in FIG. 30 in form of distance vectors from all natural source positions (dF, dR, dT, dB) to VS2'. DBAP, as has been described above, may be implemented to obtain weighting factors for all respective output channels (SF, SR, ST and SB). DBAP may be applied irrespective of the positions and number of natural sources on the unit circle. Furthermore, DBAP may be restricted to a subset of all available natural source positions depending on the position of the projected virtual source on the median plane. This may be required if natural sources are not spaced equally along the unit circle on the median plane. In this case it may be beneficial to apply additional weighting factors for certain natural source positions to compensate for a higher concentration of natural source positions in certain segments of the unit circle. DBAP may be well suited because for an equal distance of the virtual source from all physical sources on the median plane, all physical sources will play equally loud. This means that for virtual sources on the sides of the user, sound from all available loudspeakers or loudspeaker arrangements per ear that are configured to generate natural directional pinna cues will be superimposed, forming a maximally diffused sound field that either allows effective application of foreign pinna cues, or of HRTFs without pinna cues, which also works well for virtual source positions on the sides.

A further exemplary method for distributing audio signals of a specific desired virtual sound source direction over three natural or artificial pinna cue directions is known as vector base amplitude panning (VBAP). This method comprises choosing three natural or artificial pinna cue directions, over which the signal for a desired virtual source direction will subsequently be panned. All directions may be represented as coordinates on a unit sphere (spherical coordinate system) or in the 2-dimensional case a circle (polar coordinate system). The desired virtual source direction must fall into an area on the surface of the unit sphere spanned by the three pinna cue directions. Panning factors may then be calculated according to the known method of VBAP for all three pinna cue directions. A modification of VBAP that targets at more uniform source spread is known as multiple-direction amplitude panning (MDAP). MDAP can be described as VBAP for multiple virtual source directions around the target virtual source. MDAP results in source spread widening for virtual source directions that coincide with physical source directions. The proposed panning laws for ADCF3D and NDCF3D are merely examples. Other panning laws may be applied in order to distribute virtual source signals between available natural sources or to mix in pinna cues to various extends without deviating from the scope of the disclosure.

Figure 31:
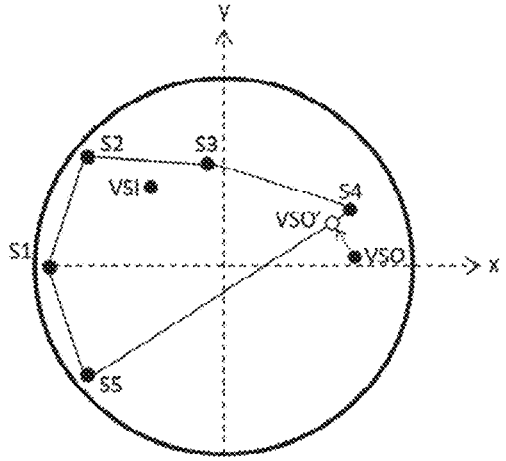
FIG. 31 schematically illustrates projected virtual source positions as well as positions associated with natural or directional pinna cues within a unit circle on the median plane.

Another exemplary panning law or method for distributing audio signals of a specific desired virtual source direction over multiple natural or artificial pinna cue directions is described hereafter. This method is based on linear interpolation and may be applied irrespective of the number of available natural or artificial cue directions as well as their position on or within the unit circle. Therefore, it may, for example, also be applied in the context of the second processing method described above with respect to FIG. 19. The method may be referred to as stepwise linear interpolation. Similar to virtual source positions that are projected onto the median plane from a unit sphere around the user, vertical projections onto the median plane of positions on the unit sphere corresponding to specific natural or artificial cue directions, fall into the unit circle (distance to the center of the unit circle <1) if their azimuth angle is neither 0° nor 180°. This, for example, may result from the placement and construction of physical sound sources employed to induce natural directional pinna cues. In the example illustrated in FIG. 31, all source positions (S1 to S5) are positioned within the unit circle. These projected source positions are now defined by their x- and y-coordinates in the two-dimensional Cartesian coordinate system. The available natural and/or artificial pinna cue directions may constrict the directions that can be represented by panning over the loudspeaker assemblies or signal processing paths that induce the corresponding natural or artificial pinna cues. Nevertheless, it may be possible to generate virtual sources with sufficient localization accuracy. In the example of FIG. 31, available pinna cue directions S1 to S5, which may be natural and/or artificial, span an area of sufficient pinna cue coverage within the connecting lines. Within the range of directions represented by this area, virtual sources can be supported with matching pinna cues while outside this range generally no matching pinna cues are available.

Figure 32:
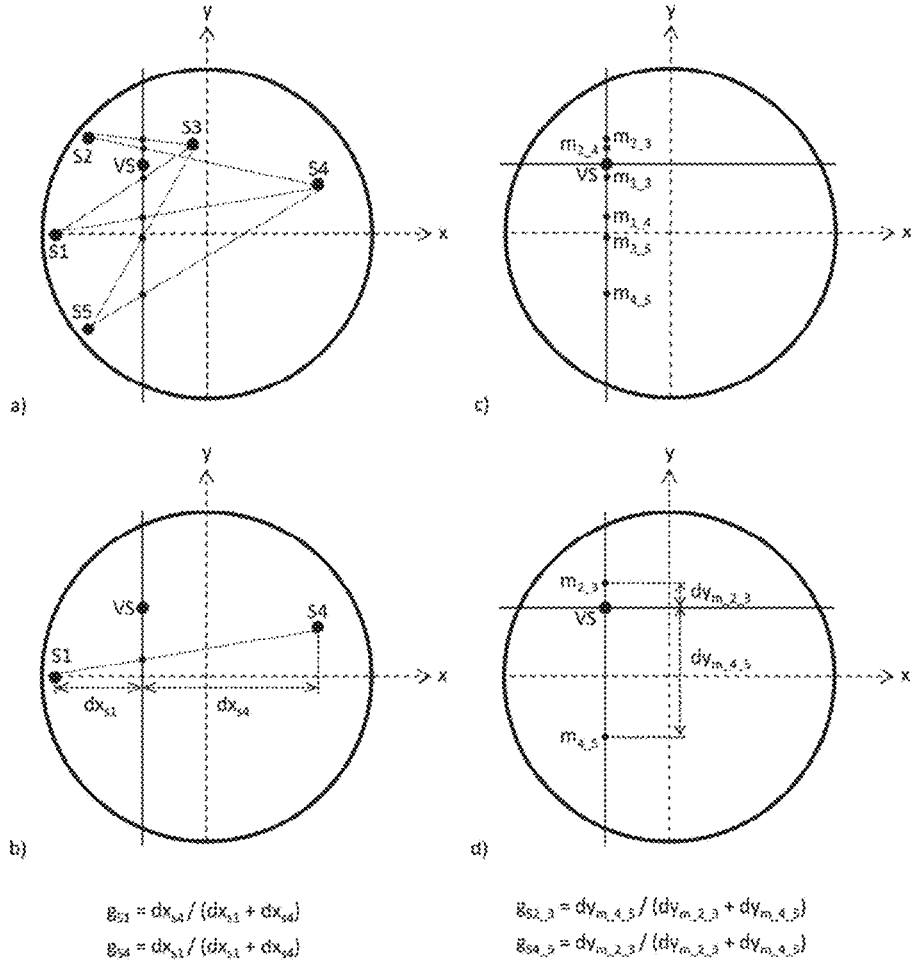
FIG. 32 schematically illustrates several exemplary steps of a method for determining the panning factors for the distribution of audio signals associated with specific virtual source positions over positions that are associated with natural or directional pinna cues.

For example, the internal virtual source VSI may be panned over pinna cues associated with directions surrounding the virtual source direction while pinna cues from a lower frontal direction are missing for the external virtual source VSO. Therefore, the external source may be shifted to the closest available direction concerning pinna cues, before calculating panning factors for available pinna cue directions. If this direction is not too far off, the resulting virtual source position may still be sufficiently accurate. This approach is also schematically illustrated in FIG. 31, where VSO' is determined by shifting VSO to the nearest position within the area of sufficient pinna cue coverage. In order to determine the panning factors by which a virtual source signal is distributed over at least part of the available pinna cue directions (either implemented by physical sources providing natural pinna cues or HRTF-based filters providing artificial pinna cues), the following steps described with reference to FIGS. 32 *a*) to 32 *d*) may be performed. In FIG. 32 *a*), exemplary available pinna cue directions are designated as S1 to S5 and the desired virtual source direction is designated as VS. As has been described above, the respective positions that represent these directions in the Cartesian coordinate system of FIG. 32, may be determined from the respective azimuth and elevation angles that describe the respective direction within a spherical coordinate system as is exemplarily illustrated in FIGS. 3 and 28 by a perpendicular projection onto the median plane.

For this projection, the distance of the source positions from the center of the spherical coordinate system is set to 1, placing the source positions on a unit sphere. The panning method comprises two main panning steps in which a first panning factor set is calculated based on the x-coordinate and afterwards a second set is calculated based on the y-coordinate of the pinna cue directions and the virtual source direction respectively within the Cartesian coordinate system. In a first step, the pinna cue directions are parted into two possibly overlapping groups (G1 and G2) based on their respective x-coordinate. The parting line is the line along the x-coordinate of the virtual source direction (VS). Pinna cue directions that have an equal x-coordinate as the virtual source direction fall into both groups ($x_{G1}<=x_{VS}<=x_{G2}$). In a next step, panning factors may be calculated for all combinations without repetition of single pinna cue directions from the first group with single pinna cue directions from the second group. In FIG. 32 *a*), the dotted lines between pinna cue directions represent all possible combinations (e.g. S1 with S4) between directions on the left and right of the vertical axis along the x-coordinate of VS.

A panning factor calculation for both respective pinna cue directions within any combination is exemplarily illustrated in FIG. 32 *b*) for S1 and S4. From the absolute difference of the x-coordinate of both respective pinna cue directions from the x-coordinate of the virtual source direction (e.g. $dx_{s1}$ for S1 and $dx_{s4}$ for S4 in FIG. 32 *b*), or more general $d_{xi}$ and $d_{xj}$), the panning factors for both pinna cue directions (Si and Sj) may be calculated as $g_{si}=dx_{sj}/(dx_{si}+dx_{sj})$ and $g_{sj}=dx_{si}/(dx_{si}+dx_{sj})$. The first panning factor set containing gain factors for both pinna cue directions of all combinations of pinna cure directions, calculated as previously described, may comprise multiple gain factors per pinna cue direction. The first main panning step results in interim mixes (e.g. $m_{2_3}$ in FIG. 32 *c*) between the pinna cue directions contained within all respective combinations of pinna cue directions. For these interim mixes, the x-coordinate equals the x-coordinate of the virtual source, and the y-coordinate may be calculated as $y_{mi_j}=g_{si}*y_i+g_{sj}*y_j$. For the second main panning step, the mixes obtained in the first main panning step are again parted into two groups (MG1 and MG2), based on their respective y-coordinate. The parting line is the line along the y-coordinate of the virtual source direction (exemplary illustrated in FIG. 32 *c*)). Interim mixes of pinna cue directions that have the same y-coordinate as the virtual source direction, fall into both groups ($y_{MG1}<=y_{VS}<=y_{MG2}$). At this point, it is possible to choose only a subset of all interim mixes for further calculations. This may, for example, be done based on the pinna cue directions contained in the interim mix, the deviation of the y-coordinate of the interim mix or the individual pinna cue directions respectively from the y-coordinate of the virtual source direction or the difference between the x- and/or y-coordinate of pinna source directions contained in the mix. Furthermore, the distance of the pinna cue directions in the interim mix from the virtual source direction in the Cartesian or the spherical coordinate system may be a basis for interim mix selection. However, it may be required that each group of interim mixes comprises at least one interim mix. Panning factors of the second main panning step may be calculated for all combinations without repetition of single interim mixes from the first group MG1 with single interim mixes from the second group MG2.

A panning factor calculation for both respective interim mixes within any combination is exemplarily illustrated in FIG. 32 *d*) for interim mixes $m_{2_3}$ and $m_{4_5}$. From the absolute difference of the y-coordinate of both respective interim mixes from the y-coordinate of the virtual source direction (e.g. $dy_{m_2_3}$ for $m_{2_3}$ and $dy_{m_4_5}$ for $m_{4_5}$ in FIG. 32 *d*) or, more general, $dy_{m_i_j}$ and $dy_{m_k_l}$) the panning factors for both interim mixes ($m_{i_j}$ and $m_{k_l}$) may be calculated as $g_{m_i_j}=dy_{m_k_l}/(dy_{m_i_j}+dy_{m_k_l})$ and $g_{m_k_l}=dy_{m_i_j}/(dy_{m_i_j}+dy_{m_k_l})$. The second panning factor set comprising gain factors for both interim mixes of all interim mix combinations, calculated as previously described, may comprise multiple gain factors per interim mix. A complete set of panning factors for all involved pinna cue directions may be obtained by multiplication of the panning factors for panning of the interim mixes ($g_{m_i_j}$, $g_{m_k_l}$) towards the virtual source direction with the respective panning factors for panning of the pinna cue directions towards the interim mix directions ($g_{si}$, $g_{sj}$). In other words, every mix of interim mixes corresponds to two underlying sub-mixes of pinna cue directions, one sub-mix for each interim mix. For these sub-mixes, panning factors for both pinna cue directions are available in the first panning factor set. The second panning factor set contains panning factors for each interim mix. The panning factors of the sub mixes may be multiplied with the panning factors of the corresponding interim mixes, which results in a set of four panning factors per interim mix, each panning factor associated with a specific pinna cue direction. The complete set of panning factors for all involved pinna cue directions may be obtained by calculation of these four panning factors for every interim mix. This will result in a set of panning factors that may comprise multiple panning factors per pinna cue direction. For normalization of the resulting virtual source gain to 1, all panning factors per pinna cue direction may be divided by the sum of all panning factors of the complete set of panning factors for all involved pinna cue directions. The normalized panning factors may now be summed per pinna cue direction which results in the final panning factor for the respective pinna cue directions.

Figure 33:
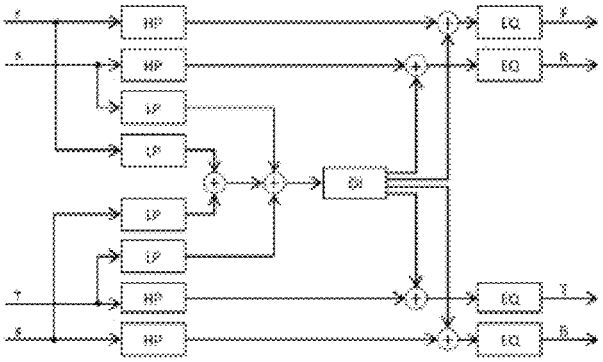
FIG. 33 schematically illustrates an example of signal distribution and equalizing for loudspeaker arrangements that are configured to provide natural directional pinna cues.

The proposed panning method may be used for all constellations of available pinna cue directions that generally support a specific desired virtual source direction. A single pinna cue direction only supports a single virtual source direction. Two distant pinna cue directions support any virtual source direction on a line between the pinna cue directions. Three pinna cue directions that do not fall on a straight line support any virtual source direction within the triangle spanned by these pinna cue directions. Generally, for any constellation of available pinna cue directions projected onto the aforementioned unit circle in the median plane, the largest area that can be encompassed by straight lines between the Cartesian coordinates representing the directions of the pinna cues, corresponds to the area of sufficient pinna cue coverage mentioned above. For the synthesis of a given virtual source direction, it is not necessarily required to include all available pinna cue directions. Therefore, a preselection of pinna cue directions may be performed that are included in the panning process. Besides the requirement that the chosen pinna cue directions should sit on a point or a line or span an area that cover the desired virtual source direction, other selection criteria may apply. For example, the distance of the pinna cue directions from the virtual source direction in the Cartesian coordinate system may be kept short or virtual sources within a specific elevation and/or azimuth range may all be panned over the same pinna cue directions. The proposed panning method provides the required versatility to support any desired virtual source position within the area of sufficient pinna cue coverage. The described stepwise linear interpolation approach may result in variable source spread for various virtual source positions. A reason for this is that virtual source positions that coincide with physical source positions within the Cartesian coordinate system will be panned solely to those physical sources. As a result, the source spread is minimal for virtual sources at the position of physical sources and increases in between physical source positions, as multiple physical sources are mixed. In order to get less source spread variation over multiple virtual source positions, the proposed panning by stepwise linear interpolation may be carried out for two or more secondary virtual source positions surrounding the target virtual source position. For example, two secondary virtual source positions may be chosen that variate the x- or y-coordinate of the target virtual source position by an equal amount in both directions. Four secondary virtual source positions may be chosen, that variate the x- and y-coordinate of the target virtual source position by an equal amount in both respective directions. Variation of target virtual source directions to receive secondary virtual source directions may also be conducted on the spherical coordinates before transformation to the two-dimensional Cartesian coordinate system. The panning factors of multiple secondary virtual source directions may be added per physical source and divided by the number of secondary virtual sources for normalization The EQ/XO blocks according to FIG. 27 support equalizing EQ and bass management for four loudspeakers or loudspeaker arrangements. A more detailed processing flow is illustrated referring to FIG. 33. As has been described before for other implementation examples of the EQ/XO blocks, complementary high-pass (HP) and low-pass (LP)

filters may be applied to the four input channels. For bass management, the low frequency part is then distributed across all loudspeaker arrangements, either equally or aligned to their respective low frequency capabilities by the distribution (DI) block. Equalizing EQ includes amplitude, time of sound arrival and possibly phase alignment of all loudspeakers or loudspeaker arrangements. For DBAP physical sources may be equally loud over frequency and preferably provide equal phase angles and time of sound arrival at the user's position, which in the given case may be a point on the pinna, probably around the concha area or at the entry of the ear canal. Spatial averaging during equalization may be advantageous if physical locations of the sound sources with respect to the pinna, concha or ear canal are not clearly defined, which is typically the case for a sound device of fixed dimensions worn by human individuals.

For DBAP, VBAP, MDAP, and stepwise linear interpolation, as described above, it has been assumed that the sound sources are arranged on a unit circle around the center of the user's head or on a hemisphere around an ear of the user. For the alignment of amplitude, phase and time of sound arrival from physical sources, the pinna area or probably only the concha area or even only the ear canal area are considered to be the region for which signals from physical sources need to be aligned. Spatial averaging over these regions or possibly further extended regions, for example by averaging over multiple microphone positions, may be carried out during equalizing in order to account for uncertainties of relative positioning between physical sound sources and the respective regions. Especially amplitude and time of arrival may be aligned for physical sources combined by the natural directional cue fading methods as described above.

As has been described above by means of several different examples, a method for binaural synthesis of at least one virtual sound source may comprise operating a first device. The first device comprises at least four physical sound sources, wherein, when the first device is used by a user, at least two physical sound sources are positioned closer to a first ear of the use than to a second ear, and at least two physical sound sources are positioned closer to the second ear than to the first ear. For each ear of the user, at least two physical sound sources are configured to acoustically induce natural directional pinna cues associated with different directions of sound arrival at the ear of the user. The method further comprises receiving and processing at least one audio input signal and distributing at least one processed version of the audio input signal at least between 4 kHz and 12 kHz over at least two physical sound sources. For example, at least two physical sound sources are arranged such that a distance between each of the sound sources and the right ear of a user is less than a distance between each of the sound sources and the left ear of the user. In this way, at least two sound sources provide sound primarily to the right ear and may induce natural directional pinna cues to the right ear. The at least two further physical sound sources are arranged such that a distance between each of the sound sources and the left ear is less than a distance between each of the sound sources and the right ear. In this way, the at least two further sound sources provide sound primarily to the left ear and may induce natural directional pinna cues to the left ear. Physical sound sources may, for example, comprise one or more loudspeakers, one or more sound canal outlets, one or more sound tube outlets, one or more acoustic waveguide outlets, and one or more acoustic reflectors.

The sound sources providing sound primarily to the right ear each may provide sound to the right ear from different directions. For example, one sound source may be arranged in front of the user's ear to provide sound from a frontal direction, and another sound source may be arranged behind the user's ear to provide sound from a rear direction. The sound of each sound source arrives at the user's ear from a certain direction. An angle between the directions of sound arrival from two different sound sources may be at least 45°, at least 90°, or at least 110°, for example. This means, that at least two sound sources are arranged at a certain distance from each other to be able to provide sound from different directions.

The processing of at least one audio input signal may comprise applying at least one filter to the audio input signal, and the at least one filter may comprise a transfer function. The transfer function of the at least one filter approximates at least one aspect of at least one measured or simulated head related transfer function HRTF of at least one human or dummy head or a numerical head model. If an acoustically or numerically generated HRTF contains influences of a pinna (e.g. pinna resonances), it may improve localization if these pinna influences are suppressed within the transfer function of a filter based on the HRTF, if individual natural pinna resonances for the user are contributed by the loudspeaker arrangement. The method, therefore, may further comprise at least partly suppressing resonance magnification and cancellation effects caused by pinnae within the transfer function of a filter applied to the audio input signal at least for frequencies between 4 kHz and 12 kHz.

The transfer function of at least one filter may approximate aspects of at least one of interaural level differences and interaural time differences of at least one head related transfer function (HRTF) of at least one human or dummy head or numerical head model, and either no resonance and cancellation effects of pinnae are involved in the generation of the at least one HRTF, or resonance and cancellation effects of pinnae involved in the generation of the at least one HRTF, are at least partly excluded from the approximation.

For a physical sound source delivering sound towards a human or dummy head, a pair of head related transfer functions (HRTF) may be determined, each pair comprising a direct part and an indirect part. The approximation of aspects of at least one head related transfer function of at least one human or dummy head or numerical head model may comprise at least one of the following: a difference between at least one of the direct and indirect head related transfer function, the amplitude response of the direct and indirect head related transfer function, and the phase response of the direct and indirect head related transfer function; a difference between the amplitude transfer function of the indirect and direct head related transfer function for the frontal direction, and the corresponding amplitude transfer function of the direct and indirect head related transfer function for a second direction; a sum of at least one of the direct and indirect the head related transfer function, and the amplitude transfer function of the direct and indirect head related transfer function; an average of at least one of the respective direct and indirect head related transfer function, the respective amplitude response of the direct and indirect head related transfer function, and the respective phase response of the direct and indirect head related transfer function from multiple human individuals for a similar or identical relative source position; approximating an amplitude transfer function using minimum phase filters; approximating an excess delay using analog or digital signal delay; approximating an amplitude transfer function using finite impulse response filters; approximating an amplitude transfer function by using sparse finite impulse response filters; and a compensation transfer function for amplitude response alterations caused by the application of filters that approximate aspects of the head related transfer functions.

Distributing at least one processed version of the at least one audio input signal over at least two physical sound sources that are arranged closer to one ear of the user may comprise scaling the at least one processed audio input signal with an individual panning factor for each of the at least two physical sound sources, wherein the individual panning factor for each physical sound source depends on a desired perceived direction of sound arrival from the virtual sound source at the user or the user's ear and further depends on either the direction of sound arrival from each respective physical sound source at the ear of the user, or on the direction associated with the natural directional pinna cues induced acoustically at the pinna of the user's ear by each respective physical sound source.

The panning factors may depend on the relative location of two-dimensional Cartesian coordinates representing the direction of sound arrival from at least two physical sound sources at the ear of the user 2, and on two-dimensional Cartesian coordinates representing the desired direction of sound arrival from a virtual sound source at the user 2 or at the user's ear.

Panning factors for distribution of at least one processed audio input signal over at least two physical sound sources closer to one ear may depend on the relative location of two-dimensional Cartesian coordinates representing the direction of sound arrival from at least two physical sound sources at the ear of the user 2 and two-dimensional Cartesian coordinates representing the desired direction of sound arrival from a virtual sound source at the user 2 or at the user's ear, wherein the panning factors may be determined by one of: calculating interpolation factors by stepwise linear interpolation between the respective two-dimensional Cartesian coordinates x, y, representing the direction of sound arrival from the at least two physical sound sources at the ear of the user 2, at the respective two-dimensional Cartesian coordinates x, y representing the desired perceived direction of sound arrival from the virtual sound source at the user 2 or at the user's ear, and combining and normalizing the interpolation factors per physical sound source; and calculating respective distance measures between the position defined by Cartesian coordinates representing the direction of the desired virtual sound source with respect to the user 2 or the user's ear, and the positions defined by respective two-dimensional Cartesian coordinates representing the direction of sound arrival from the at least two physical sound sources at the ear of the user 2, and calculating distance-based panning factors.

Evaluating a difference between the desired perceived direction of sound arrival from a virtual sound source at the user or the user's ear and the direction of sound arrival from the respective physical sound sources at the first ear of the user may comprise, perpendicularly projecting points in a spherical coordinate system that fall onto the intersection of respective directions ($\varphi$, $\nu$) of the virtual sound sources and the physical sound sources with a sphere around the origin of the coordinate system (e.g. unit sphere with r=1), onto a plane through the coincident origin of the spherical coordinate system and the sphere, that also coincides with the frontal ($\varphi$, $\nu$=0°) and top ($\varphi$=0°, $\nu$=90° directions, and determining two-dimensional Cartesian coordinates (x, y) of the projected intersection points on the plane, where the origin of the two-dimensional Cartesian coordinate system coincides with the origin of the spherical coordinate system and one axis of the Cartesian coordinate system coincides with the frontal direction within the spherical coordinate system ($\varphi$, $\nu$=0°) and the second axis coincides with the top direction within the spherical coordinate system ($\varphi$=0°, $\nu$=90°. The method may further comprise calculating the panning factors by linear interpolation over the Cartesian coordinates of the intersection points of the respective physical sound source directions at the desired virtual sound source direction within the Cartesian coordinate system, or calculating the distance between the projected intersection points of the respective physical sound source directions and the desired virtual sound source direction within the Cartesian coordinate system and further calculating the panning factors based on these distances.

Calculating the panning factors may comprise calculating a linear interpolation of two-dimensional Cartesian coordinates representing at least two directions of sound arrival from physical sound sources at an ear of the user at two-dimensional Cartesian coordinates representing the desired virtual source direction with respect to the user, or calculating a distance between the Cartesian coordinates representing the desired virtual source direction with respect to the user, and performing distance based amplitude panning.

The individual panning factors for at least two physical sound sources arranged at positions closer to the second ear, may be equal to the panning factors for loudspeakers arranged at similar positions relative to the first ear. The first ear may be the ear on the same side of the user's head as the desired virtual sound source. The panning factors for distributing at least one processed version of one input audio signal over at least two physical sound sources arranged at positions closer to a second ear, may be equal to panning factors for distributing at least one processed version of the input audio signal over at least two physical sound sources arranged at similar positions relative to a first ear. The individual panning factor for each physical sound source closer to the first ear may depend on a desired perceived direction of sound arrival from the virtual sound source at the user 2 or the user's first ear, and may further depend on either the direction of sound arrival from each respective physical sound source at the first ear of the user 2, or on the direction associated with the natural directional pinna cues induced acoustically at the pinna of the user's first ear by each respective physical sound source. The first ear of the user 2 is the ear on the same side of the user's head as the desired perceived direction of sound arrival from a virtual sound source at the user.

The physical sound sources may be arranged such that their direction of sound arrival at the entry of the ear canal with respect to a plane, which is parallel to the median plane and which crosses the entry of the ear canal, deviates less than 30°, less than 45° or less than 60° from the plane parallel to the median plane.

Sound produced by all of the at least two respective physical sound sources per ear may be directed towards the entry of the ear canal from a direction that deviates from the direction of an axis through the ear canal perpendicular to the median plane by more than 30°, more than 45° or more than 60°. The total sound may be a superposition of sounds produced by all physical sound sources of the respective ear. The median plane crosses the user's head approximately midway between the user's ears, thereby virtually dividing the head into an essentially mirror-symmetric left half side and right half side. The physical sound sources may be located such that they do not cover the pinna or at least the concha of the user in a lateral direction. The first device may also not cover or enclose the user's ear completely, when worn by a user.

The method may further comprise synthesizing a multitude of virtual sound sources for a multitude of desired virtual source directions with respect to the user, wherein at least one audio input signal is positioned at a virtual playback position around the user by distributing the at least one audio input signal over a number of virtual sound sources.

The method may further comprise tracking momentary movements, orientations or positions of the user's head using a sensing apparatus, wherein the movements, orientations or positions are tracked at least around one rotation axis (e.g. x, y or z), and at least within a certain rotation range per rotation axis, and the instantaneous virtual playback position of at least one audio input signal is kept approximately constant with respect to the user over the range of tracked head-positions, by distributing the audio input signal over a number of virtual sound sources based on at least one instantaneous rotation angle of the head.

Distributing at least one audio input signal over the multitude of virtual sound sources comprises at least one of: distributing the audio input signal over two virtual sound sources using amplitude panning; distributing the audio input signal over three virtual sound sources using vector based amplitude panning; distributing the audio input signal over four virtual sound sources using bilinear interpolation of representations of the respective virtual sound source directions in a two-dimensional Cartesian coordinate system; distributing the audio input signal over a multitude of virtual sound sources using stepwise linear interpolation of two-dimensional Cartesian coordinates representing the respective virtual sound source directions; encoding the at least one audio input signal in an ambisonics format, decoding the ambisonics signal using multiplication with an inverse or pseudoinverse decoding matrix derived from the geometrical layout of the virtual source directions and applying the resulting signals to the respective virtual sound sources; encoding the at least one audio input signal in an ambisonics format, manipulating the sound field represented by the ambisonics format, and decoding the manipulated ambisonics signal using multiplication with an inverse or pseudoinverse decoding matrix derived from the geometrical layout of the virtual source directions and applying the resulting signals to the respective virtual sound sources.

The method may further comprise generating multiple delayed and filtered versions of at least one audio input signal, and applying the multiple delayed and filtered versions of the at least one audio input signal as input signal for at least one virtual sound source. In this way, the perceived distance from the user of the audio objects contained in the audio input signal may be controlled.

The method may further comprise receiving a binaural (two-channel) audio input signal that has been processed within at least a second device according to the direct and indirect parts of at least one head related transfer function (HRTF) measured or simulated for at least one human or dummy head or calculated from at least one numerical head model, and further applying the received input signal to the respective ear by distribution over at least two physical sound sources per ear with largely opposing directions of sound arrival at the ear (e.g. frontal and rear directions and/or directions above and below the pinna), such that the sound arriving at the ear is diffuse concerning the direction of arrival at the ear and either no distinct directional pinna cues are induced acoustically within the pinnae of the user or distinct directional pinna cues induced acoustically correspond to lateral directions (e.g. azimuth between 70° and 110° or 250° and 290° respectively and elevation between −20° and +20°).

The method may further comprise filtering the audio input signal according to the direct and indirect parts of at least one head related transfer function (HRTF) measured or simulated for at least one human or dummy head or calculated from at least one numerical head model, and further applying the resulting direct and indirect ear signal to the respective ear by distribution over at least two physical sound sources per ear with largely opposing directions of sound arrival at the ear (e.g. frontal and rear directions and/or directions above and below the pinna), such that the sound arriving at the ear is diffuse concerning the direction of arrival at the ear and either no distinct directional pinna cues are induced acoustically within the pinnae of the user or distinct directional pinna cues induced acoustically correspond to lateral directions (e.g. azimuth between 70° and 110° or 250° and 290° respectively and elevation between −20° and +20°).

According to one example, a sound device comprises at least four physical sound sources, wherein, when the sound device is used by a user, two of the physical sound sources are positioned closer to a first ear of the user than to a second ear, and two of the physical sound sources are positioned closer to the second ear than to the first ear, and wherein, for each ear of the user, at least two physical sound sources are configured to induce natural directional pinna cues associated with different directions of sound arrival at the ear of the user. The sound device further comprises a processor for carrying out the steps of the exemplary methods described above. The sound device may be integrated to a headrest or back rest of a seat or car seat, worn on the head of the user, integrated to a virtual reality headset, integrated to an augmented reality headset, integrated to a headphone, integrated to an open headphone, worn around the neck of the user, and/or worn on the upper torso of the user.

According to one example, a sound source arrangement comprises a first sound source, configured to provide sound to a first ear of a user, a second sound source, configured to provide sound to a second ear of a user, a first audio input signal, configured to be provided to the first sound source, a second audio input signal, configured to be provided to the second sound source, a phase de-correlation unit, configured to apply phase de-correlation between the first audio input signal and the second audio input signal, a crossfeed unit, configured to filter the first audio input signal and the second audio input signal, to mix the unfiltered first audio input signal with the filtered second audio input signal, and to mix the filtered first audio input signal with the unfiltered second audio input signal, and a distance control unit, configured to apply artificial reflections to the first audio input signal and the second audio input signal.

According to one example, a sound source arrangement comprises a first sound source, configured to provide sound to a first ear of a user, a second sound source, configured to provide sound to a second ear of a user, a first audio input signal, configured to be provided to the first sound source, and a second audio input signal, configured to be provided to the second sound source. A method for operating the sound source arrangement may comprise applying phase de-correlation between the first audio input signal and the second audio input signal, crossfeeding the first audio input signal and the second audio input signal, wherein crossfeeding comprises filtering the first audio input signal and the second audio input signal, mixing the unfiltered first audio input signal with the filtered second audio input signal, and mixing the filtered first audio input signal with the unfiltered second audio input signal, and applying artificial reflections to the first audio input signal and the second audio input signal.

According to a further example, a sound source arrangement comprises at least one input channel, at least one fading unit, configured to receive the input channel and to distribute the input channel to a plurality of fader output channels, at least one distance control unit, configured to receive the input channel, to apply artificial reflections to the input channel and to output a plurality of distance control output channels, a first plurality of adders, configured to add a distance control output channel to each of the fader output channels to generate a plurality of first sum channels, a plurality of HRTF processing units, wherein each HRTF processing unit is configured to receive one of the first sum channels, to perform head related transfer function based filtering and at least one of natural and artificial pinna cue fading, and to output a plurality of HRTF output signals, a second plurality of adders, configured to sum up the HRTF output signals to a plurality of second sum signals, and at least one equalizing unit, configured to receive the plurality of HRTF output signals and to perform at least one of equalizing, time alignment, amplitude level alignment and bass management on the plurality of HRTF output signals.

According to a further example, a method for operating a sound source arrangement comprising at least one input channel comprises distributing the input channel to a plurality of fader output channels, applying artificial reflections to the input channel to generate a plurality of distance control output channels, adding a distance control output channel to each of the fader output channels to generate a plurality of first sum channels, performing head related transfer function based filtering and at least one of natural and artificial pinna cue fading on the plurality of first sum channels to generate a plurality of HRTF output signals, summing up the HRTF output signals to generate a plurality of second sum signals, and performing at least one of equalizing, time alignment, amplitude level alignment and bass management on the plurality of HRTF output signals.

According to an even further example, a sound source arrangement comprises at least one audio input channel wherein each audio input channel comprises a mono signal and information about a desired position of a virtual sound source, wherein the desired position is defined at least by an azimuth angle and an elevation angle, at least one distance control unit, wherein each distance control unit is configured to receive one of the audio input channels, to apply artificial reflections to the audio input channel and to output a plurality of reflection channels, an ambisonics encoder unit, configured to receive the at least one audio input channel and the plurality of reflection channels, to pan all channels and to output a first number of ambisonics channels, an ambisonics decoder unit, configured to decode the first number of ambisonics channels and to provide a second number of virtual source channels, wherein the second number equals or is greater than the first number, a second number of HRTF processing units, wherein each HRTF processing unit is configured to receive one of the second number of virtual source channels, to perform head related transfer function based filtering and at least one of natural and artificial pinna cue fading, and to output a plurality of HRTF output signals, a plurality of adders, configured to sum up the HRTF output signals to a plurality of sum signals, and at least one equalizing unit, configured to receive the plurality of HRTF output signals and to perform at least one of equalizing, time alignment, amplitude level alignment and bass management on the plurality of HRTF output signals.

According to a further example, a sound source arrangement comprises at least one first sound source, configured to provide sound to a first ear of a user, at least one second sound source, configured to provide sound to a second ear of a user, and at least one audio input channel, wherein each audio input channel comprises a mono signal and information about a desired position of a virtual sound source, wherein the desired position is defined at least by an azimuth angle and an elevation angle. A method for operating the sound source arrangement may comprise applying artificial reflections to each of the audio input channels to generate a plurality of reflection channels, panning the audio input channels and the reflection channels to generate a first number of ambisonics channels, decoding the first number of ambisonics channels to generate a second number of virtual source channels, wherein the second number equals or is greater than the first number, performing head related transfer function based filtering and at least one of natural and artificial pinna cue fading on the second number of virtual source channels to generate a plurality of HRTF output signals, summing up the HRTF output signals to generate a plurality of sum signals, and performing at least one of equalizing, time alignment, amplitude level alignment and bass management on the plurality of HRTF output signals.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices, such as the signal processing components discussed with respect to FIG. 4. The methods may be performed by executing stored instructions with one or more logic devices (e.g., processors) in combination with one or more additional hardware elements, such as storage devices, memory, hardware network interfaces/antennas, switches, actuators, clock circuits, etc. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and subcombinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

While various embodiments have been described, it will be apparent to those of ordinary skill in the art that many more embodiments and implementations are possible within the scope of the disclosure. Accordingly, the disclosure is not to be restricted except in light of the attached claims and their equivalents.

The invention claimed is:

1. A method for binaural synthesis of at least one virtual sound source, the method comprises:

operating a first device that comprises at least four physical sound sources, wherein, when the first device is used by a user, at least two physical sound sources of the at least four physical sound sources are positioned closer to a first ear of the user than to a second ear, and at least two physical sound sources of the at least four physical sound sources are positioned closer to the second ear than to the first ear, and wherein, for each ear of the user, at least two physical sound sources of the at least four physical sound sources are configured to acoustically induce natural directional pinna cues associated with different directions of sound arrival at an ear of the user; and receiving and processing at least one audio input signal and distributing at least one processed version of the audio input signal at least between 4 kHz and 12 kHz over at least two physical sound sources of the at least four physical sound sources for each ear, wherein the processing of the at least one audio input signal comprises applying at least one filter to the audio input signal; and the at least one filter comprises a transfer function;

wherein the transfer function of the at least one filter approximates at least one aspect of at least one measured or simulated head related transfer function (HRTF) of at least one human or dummy head or a numerical head model;

wherein the transfer function of the at least one filter approximates aspects of at least one of interaural level differences and interaural time differences of the at least one HRTF of at least one human or dummy head or numerical head model; and wherein either no resonance and cancellation effects of pinnae are involved in generation of the at least one HRTF, or resonance and cancellation effects of pinnae involved in the generation of the at least one HRTF are at least partly excluded from the approximation.

2. The method of claim 1, further comprising:

delivering sound towards each ear of the user from at least two different directions using the at least two physical sound sources closer to each respective ear than to the other ear such that sound is received at each ear of the user from at least two directions of sound arrival; wherein an angle between two directions of sound arrival at each respective ear is at least 45°.

3. The method of claim 1, wherein the approximation of aspects of the at least one HRTF of at least one human or dummy head or numerical head model comprises at least one of:

a difference between at least one of a direct and indirect HRTF, an amplitude response of the direct and indirect HRTF, and a phase response of the direct and indirect HRTF;

a difference between the amplitude transfer function of the indirect and direct HRTF respectively for a frontal direction ($\varphi$, $\upsilon$=0°), and the corresponding amplitude transfer function of the direct and indirect HRTF for a second direction;

a sum of at least one of the direct and indirect HRTF and the amplitude transfer function of the direct and indirect HRTF;

an average of at least one of the respective direct and indirect HRTF, the respective amplitude response of the direct and indirect HRTF, and the respective phase response of the direct and indirect HRTF from multiple human individuals for a similar or identical relative source position;

approximating an amplitude transfer function using minimum phase filters, approximating an excess delay using analog or digital signal delay;

approximating the amplitude transfer function using finite impulse response filters;

approximating the amplitude transfer function by using sparse finite impulse response filters; and a compensation transfer function for amplitude response alterations caused by the application of filters that approximate aspects of HRTFs.

4. The method of claim 1, wherein distributing at least one processed version of the at least one audio input signal over at least two physical sound sources that are arranged closer to one ear of the user comprises:

scaling the at least one processed audio input signal with an individual panning factor for each of the at least two physical sound sources, wherein the individual panning factor for each physical sound source depends on a desired perceived direction of sound arrival from the virtual sound source at the user or at the user's ear and further depends on either the direction of sound arrival from each respective physical sound source at the ear of the user, or on the direction associated with the natural directional pinna cues induced acoustically at a pinna of the user's ear by each respective physical sound source.

5. The method of claim 4, wherein the panning factors depend on a relative location of two-dimensional Cartesian coordinates representing the direction of sound arrival from at least two physical sound sources at the ear of the user, and on two-dimensional Cartesian coordinates representing the desired direction of sound arrival from the virtual sound source at the user or at the user's ear.

6. The method of claim 4, wherein the panning factors for distribution of at least one processed audio input signal over at least two physical sound sources closer to one ear depend on the relative location of two-dimensional Cartesian coordinates representing the direction of sound arrival from at least two physical sound sources at the ear of the user and two-dimensional Cartesian coordinates representing the desired direction of sound arrival from the virtual sound source at the user or at the user's ear, and wherein the panning factors can be determined by one of:

calculating interpolation factors by stepwise linear interpolation between the respective two-dimensional Cartesian coordinates (x, y) representing the direction of sound arrival from the at least two physical sound sources at the ear of the user at the respective two-dimensional Cartesian coordinates (x, y) representing the desired perceived direction of sound arrival from the virtual sound source at the user or at the user's ear, and combining and normalizing the interpolation factors per physical sound source; and calculating respective distance measures between the position defined by Cartesian coordinates representing the direction of the desired virtual sound source with respect to the user or the user's ear, and the positions defined by respective two-dimensional Cartesian coordinates representing the direction of sound arrival from the at least two physical sound sources at the ear of the user, and calculating distance-based panning factors.

7. The method of claim 6, wherein the panning factors for distributing at least one processed version of one input audio signal over at least two physical sound sources arranged at positions closer to the second ear, are equal to panning factors for distributing at least one processed version of the input audio signal over at least two physical sound sources arranged at similar positions relative to the first ear;

the individual panning factor for each physical sound source closer to the first ear depends on the desired perceived direction of sound arrival from the virtual sound source at the user or the user's first ear, and further depends on either the direction of sound arrival from each of the at least two physical sound sources at the first ear of the user, or on the direction associated with the natural directional pinna cues induced acoustically at the pinna of the user's first ear by each of the at least two physical sound sources; and the first ear of the user is the ear on the same side of a user's head as the desired perceived direction of sound arrival from a virtual sound source at the user.

8. The method of claim 1, further comprising directing sound to an entry of an ear canal of the user at an angle with respect to a plane that crosses through the ear canal of the user and that is parallel to a median plane, wherein the angle is less than 60°, less than 45°, or less than 30°, and wherein a total sound is a superposition of sounds produced by all physical sound sources of the respective ear, and wherein the median plane crosses a user's head approximately midway between the user's ears, thereby virtually dividing the head into an essentially mirror-symmetric left half side and right half side.

9. The method of claim 1, further comprising synthesizing a multitude of virtual sound sources for a multitude of desired virtual source directions with respect to the user, wherein at least one audio input signal is positioned at a virtual playback position around the user by distributing the at least one audio input signal over a number of virtual sound sources.

10. The method of claim 9, further comprising tracking momentary movements, orientations, or positions of a user's head using a sensing apparatus, wherein the movements, orientations, or positions are tracked at least around one rotation axis (x, y, z), and at least within a certain rotation range per rotation axis, and the instantaneous virtual playback position of at least one audio input signal is kept approximately constant with respect to the user over the range of tracked head-positions, by distributing the audio input signal over the number of virtual sound sources based on at least one instantaneous rotation angle of the head.

11. The method of claim 9, wherein distributing at least one audio input signal over a multitude of virtual sound sources comprises at least one of:

distributing the audio input signal over two virtual sound sources using amplitude panning;

distributing the audio input signal over three virtual sound sources using vector based amplitude panning;

distributing the audio input signal over four virtual sound sources using bilinear interpolation of representations of the respective virtual sound source directions in a two-dimensional Cartesian coordinate system;

distributing the audio input signal over a multitude of virtual sound sources using stepwise linear interpolation of two-dimensional Cartesian coordinates representing the respective virtual sound source directions;

encoding the at least one audio input signal in an ambisonics format, decoding an ambisonics signal using multiplication with an inverse or pseudoinverse decoding matrix derived from a geometrical layout of the virtual source directions and applying the resulting signals to the respective virtual sound sources;

encoding the at least one audio input signal in the ambisonics format, manipulating a sound field represented by the ambisonics format, and decoding the manipulated ambisonics signal using multiplication with the inverse or pseudoinverse decoding matrix derived from the geometrical layout of the virtual source directions and applying the resulting signals to the respective virtual sound sources.

12. The method of claim 1, further comprising generating multiple delayed and filtered versions of at least one audio input signal; and applying the multiple delayed and filtered versions of the at least one audio input signal as input signals for at least one virtual sound source.

13. A sound device comprising:

at least four physical sound sources, wherein, when the sound device is used by a user, two of the physical sound sources of the at least four physical sound sources are positioned closer to a first ear of the user than to a second ear, and two of the physical sound sources of the at least four physical sound sources are positioned closer to the second ear than to the first ear, and wherein, for each ear of the user, at least two physical sound sources of the at least four physical sound sources are configured to induce natural directional pinna cues associated with different directions of sound arrival at the ear of the user;

a processor; and memory storing instructions executable by the processor to:

receive and process at least one audio input signal and distribute at least one processed version of the audio input signal at least between 4 kHz and 12 kHz over at least two of the physical sound sources of the at least four physical sound sources for each ear, wherein the processing of at least one audio input signal comprises applying at least one filter to the audio input signal; and the at least one filter comprises a transfer function;

wherein the transfer function of the at least one filter approximates at least one aspect of at least one measured or simulated head related transfer function (HRTF) of at least one human or dummy head or a numerical head model;

wherein the transfer function of the at least one filter approximates aspects of at least one of interaural level differences and interaural time differences of at least one HRTF of at least one human or dummy head or numerical head model; and wherein either no resonance and cancellation effects of pinnae are involved in generation of the at least one HRTF, or resonance and cancellation effects of pinnae involved in the generation of the at least one HRTF are at least partly excluded from the approximation.

14. The sound device of claim 13, wherein distributing at least one processed version of the at least one audio input signal over at least two physical sound sources of the at least four physical sound sources that are arranged closer to one ear of the user comprises:

scaling the at least one processed audio input signal with an individual panning factor for each of the at least two physical sound sources, wherein the individual panning factor for each physical sound source depends on a desired perceived direction of sound arrival from a virtual sound source at the user or at a user's ear and further depends on either the direction of sound arrival from each respective physical sound source at the ear of the user, or on the direction associated with the natural directional pinna cues induced acoustically at the pinna of the user's ear by each respective physical sound source.

15. The sound device of claim 13, the instructions further executable to synthesize a multitude of virtual sound sources for a multitude of desired virtual source directions with respect to the user, wherein at least one audio input signal is positioned at a virtual playback position around the user by distributing the at least one audio input signal over a number of virtual sound sources.

16. The sound device of claim 13, wherein the at least four physical sound sources comprise one or more of a loudspeaker, a sound canal outlet, a sound tube outlet, an acoustic waveguide outlet, and an acoustic reflector.

17. A sound system comprising:

at least four physical sound sources each configured to emit sound from respective directions, the at least four physical sound sources including a first group of at least two physical sound sources of the at least four physical sound sources and a second group of at least two physical sound sources of the at least four physical sound sources, the first group configured to induce natural directional pinna cues associated with different directions of sound arrival at a first selected position, and the second group configured to induce natural directional pinna cues associated with different directions of sound arrival at a second selected position;

a processor; and memory storing instructions executable by the processor to:

receive and process at least one audio input signal by applying a filter to the audio input signal, the filter having a transfer function approximating at least one aspect of at least one measured or simulated head related transfer function (HRTF) of at least one human or dummy head or a numerical head model, and distribute at least one processed version of the audio input signal at least between 4 kHz and 12 kHz over each of the first group and the second group of physical sound sources by scaling the at least one processed audio input signal with an individual panning factor for each of the physical sound sources of the first group and the second group, wherein the processing of at least one audio input signal comprises applying at least one filter to the audio input signal; and the at least one filter comprises a transfer function;

wherein the transfer function of the at least one filter approximates at least one aspect of at least one measured or simulated HRTF of at least one human or dummy head or the numerical head model;

wherein the transfer function of the at least one filter approximates aspects of at least one of interaural level differences and interaural time differences of at least one HRTF of at least one human or dummy head or numerical head model; and wherein either no resonance and cancellation effects of pinnae are involved in generation of the at least one HRTF, or resonance and cancellation effects of pinnae involved in the generation of the at least one HRTF are at least partly excluded from the approximation.

* * * * *